US011086266B2

(12) United States Patent
Inoue et al.

(10) Patent No.: US 11,086,266 B2
(45) Date of Patent: Aug. 10, 2021

(54) IMAGE FORMING APPARATUS

(71) Applicant: Oki Data Corporation, Tokyo (JP)

(72) Inventors: Takao Inoue, Tokyo (JP); Tomoya Urabe, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 35 days.

(21) Appl. No.: 16/358,637

(22) Filed: Mar. 19, 2019

(65) Prior Publication Data

US 2019/0302677 A1 Oct. 3, 2019

(30) Foreign Application Priority Data

Mar. 30, 2018 (JP) ..... JP2018-067582

(51) Int. Cl.
*G03G 21/16* (2006.01)
*G03G 21/20* (2006.01)

(52) U.S. Cl.
CPC ..... *G03G 21/1633* (2013.01); *G03G 21/203* (2013.01)

(58) Field of Classification Search
CPC ... G03G 21/1633; G03G 21/203; B41J 29/00; B41J 29/023; B41J 29/026; B41J 29/02
See application file for complete search history.

(56) References Cited

FOREIGN PATENT DOCUMENTS

| | | | |
|---|---|---|---|
| JP | 2000-31657 | A | 1/2000 |
| JP | 2002-137493 | A | 5/2002 |
| JP | 2015-096910 | A | 5/2015 |
| JP | 2016-90641 | A | 5/2016 |

*Primary Examiner* — Kristal Feggins
(74) *Attorney, Agent, or Firm* — Metrolex IP Law Group, PLLC

(57) ABSTRACT

An image forming apparatus according to an aspect of one or more embodiments may include: an image forming part that forms an image; a housing that houses the image forming part and includes an inner wall surface; and a cover attached to the housing so as to be movable between a position close to the housing and a position away from the housing. The cover includes a liquid receiver that receives a liquid getting into the housing, and the liquid receiver is adjacent to the inner wall surface in the state where the cover is close to the housing.

16 Claims, 22 Drawing Sheets

IMAGE FORMING APPARATUS

CROSS REFERENCE TO RELATED APPLICATIONS

This application claims priority based on 35 USC 119 from prior Japanese Patent Application No. JP2018-067582 filed on Mar. 30, 2018, entitled "IMAGE FORMING APPARATUS", the entire contents of which are incorporated herein by reference.

BACKGROUND

The disclosure relates to an image forming apparatus that forms an image on a medium.

Electrophotographic image forming apparatuses that form images with toners are widely used. This is because such an image forming apparatus can obtain a clear image in a short time compared with other types of image forming apparatuses such as an ink-jet type.

Such an image forming apparatus can be opened and closed as needed. However, if the image forming apparatus can be opened and closed, a liquid such as water gets by accident into the image forming apparatus through a gap and the like, and such entry of the liquid may cause various problems. Therefore, some approaches have been examined to mend the problems related to the entry of the liquid.

To be more specific, in order to prevent an operation control board from getting wet due to the entry of the liquid, a receiving member that receives a liquid is installed inside the image forming apparatus (see, for example, Patent Document 1: Japanese Patent Application Publication No. 2015-096910). This receiving member receives the liquid and then causes the liquid to flow into a region where the operation control board is not disposed.

SUMMARY

There have been examined measures to mend the problems related to the entry of the liquid, but such measures are not yet satisfactory. Therefore, there is still room for improvement to enhance the convenience of the image forming apparatus in use.

It is an object of the present disclosure to provide an image forming apparatus capable of enhancing convenience in use.

A first aspect of one or more embodiments may be an image forming apparatus that includes: an image forming part that forms an image; a housing that houses the image forming part and includes an inner wall surface; and a cover attached to the housing so as to be movable between a position close to the housing and a position away from the housing. The cover includes a liquid receiver that receives a liquid getting into the housing, and the liquid receiver is adjacent to the inner wall surface when the cover is close to the housing.

A second aspect of one or more embodiments may be an image forming apparatus that includes: an image forming part that forms an image; a power source that activates the image forming part; a housing that houses the image forming part and the power source, and includes a first detachably attachable housing member with a drainage port and a second detachably attachable housing member with a slit; and a cover attached to the housing so as to be movable through the slit. The housing includes a liquid guidance part that guides a liquid getting into the housing from the slit to the drainage port.

According to the first aspect, the image forming part is housed in the housing, the cover movably attached to the housing includes the liquid receiver, and the liquid receiver is adjacent to the inner wall surface of the housing when the cover is close to the housing. Thus, the convenience in use can be enhanced.

According to the second aspect, the image forming part and the power source are housed inside the housing including the drainage port and the slit, the cover is attached to the housing so as to be movable through the slit, the housing includes the liquid guidance part, and the liquid guidance part guides the liquid getting into the housing from the slit to the drainage port. Thus, the convenience in use can be enhanced.

DETAILED DESCRIPTION

Figure 1:
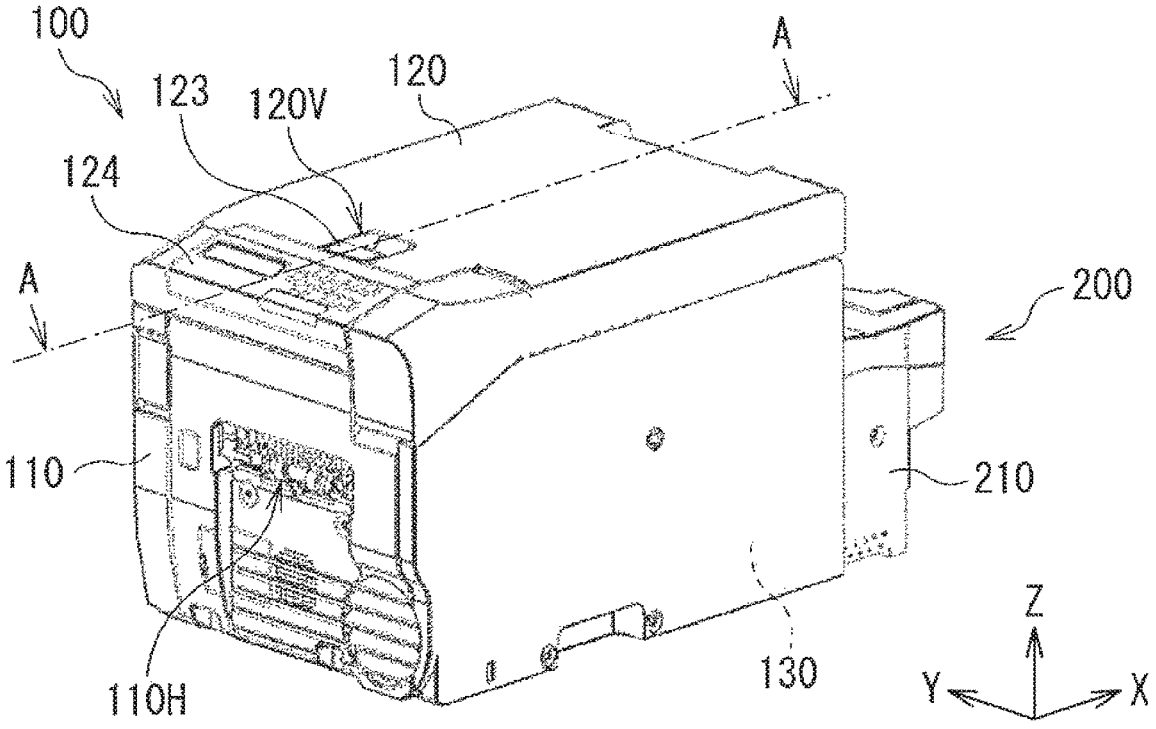
FIG. 1 is a diagram illustrating a perspective view of a configuration of an image forming apparatus (with a top cover closed) according to a first embodiment.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

Note that the description is given in the following order.

1. Image Forming Apparatus (First Embodiment)
  1-1. Overall Configuration
  1-2. Configuration of Image Forming Device
  1-3. Configuration of Liquid Guidance Case
  1-4. Operations
  1-5. Advantageous Effects
2. Image Forming Apparatus (Second Embodiment)
  2-1. Configuration
  2-2. Operations
  2-3. Advantageous Effects
3. Image Forming Apparatus (Third Embodiment)
  3-1. Overall Configuration
  3-2. Configuration of Liquid Guidance part
  3-3. Operations
  3-4. Advantageous Effects
4. Modified Example

1. Image Forming Apparatus (First Embodiment)

An image forming apparatus according to a first embodiment is described.

The image forming apparatus described here is a so-called electrophotographic full-color printer that forms an image on a medium M (see FIG. 8) with a toner T (see FIG. 9) as described later. This image forming apparatus forms an image on the medium M, for example, after cutting the medium M wound up in a roll shape.

Note that the kind of the medium M is not particularly limited, but one or two or more kinds of media are selected, for example, from paper, films, and the like.

<1-1. Overall Configuration>

First, the overall configuration of the image forming apparatus is described.

Figure 2:
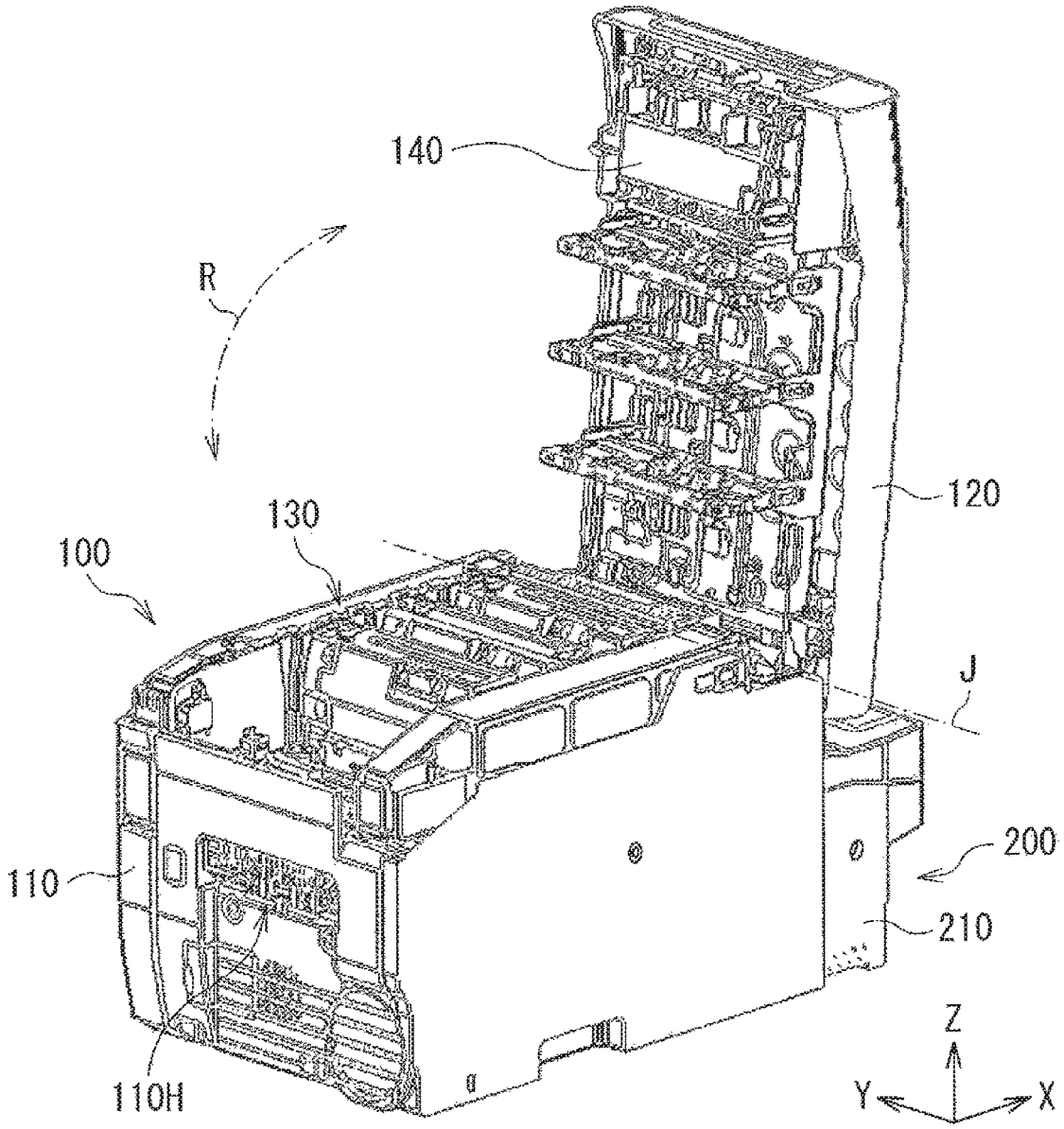
FIG. 2 is a diagram illustrating a perspective view of the configuration of the image forming apparatus illustrated in FIG. 1 (with the top cover opened)

FIGS. 1 and 2 are perspective views each illustrating the configuration of the image forming apparatus. Note that FIG. 1 illustrates a state where a top cover 120 is closed, while FIG. 2 illustrates a state where the top cover 120 is opened.

Figure 3:
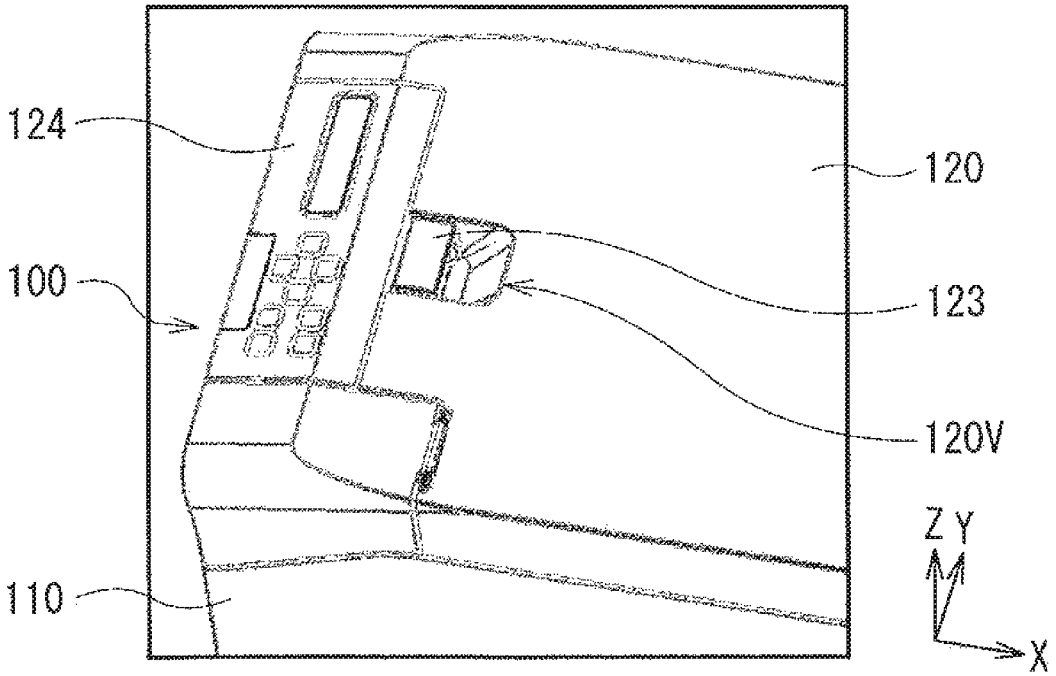
FIG. 3 is a diagram illustrating a partially enlarged perspective view of the configuration of the image forming apparatus illustrated in FIG. 1.
Figure 4:
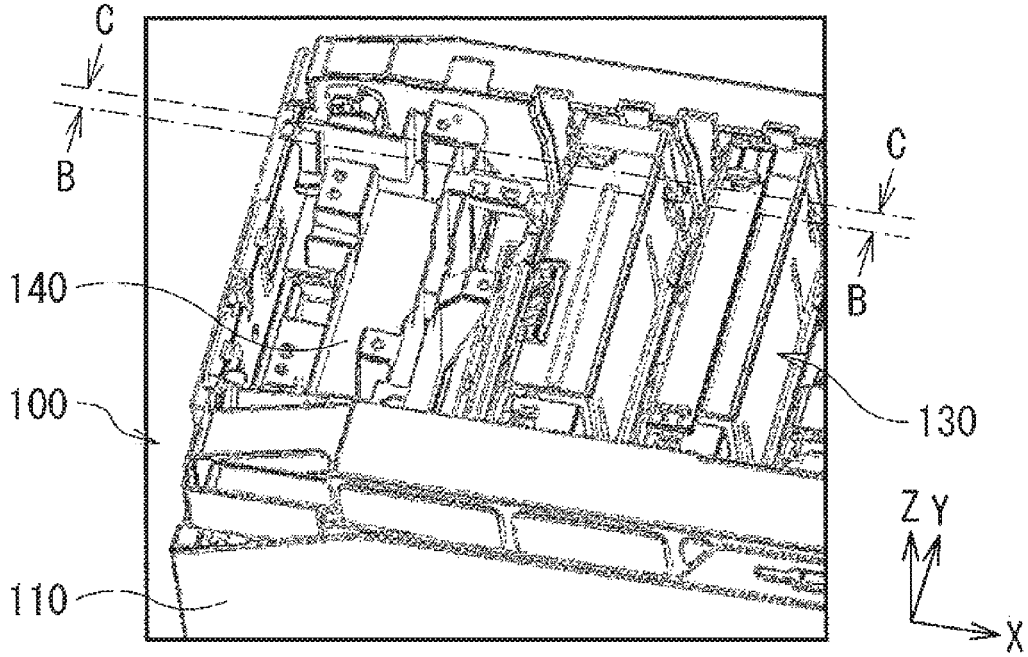
FIG. 4 is a diagram illustrating another partially enlarged perspective view of the configuration of the image forming apparatus illustrated in FIG. 1.

FIGS. 3 and 4 are partially enlarged perspective views each illustrating the image forming apparatus illustrated in FIG. 1. Note that FIG. 4 illustrates a state where only the top cover 120 is removed from the image forming apparatus (a state where a liquid guidance case 140 is disengaged from the top cover 120).

Figure 5:
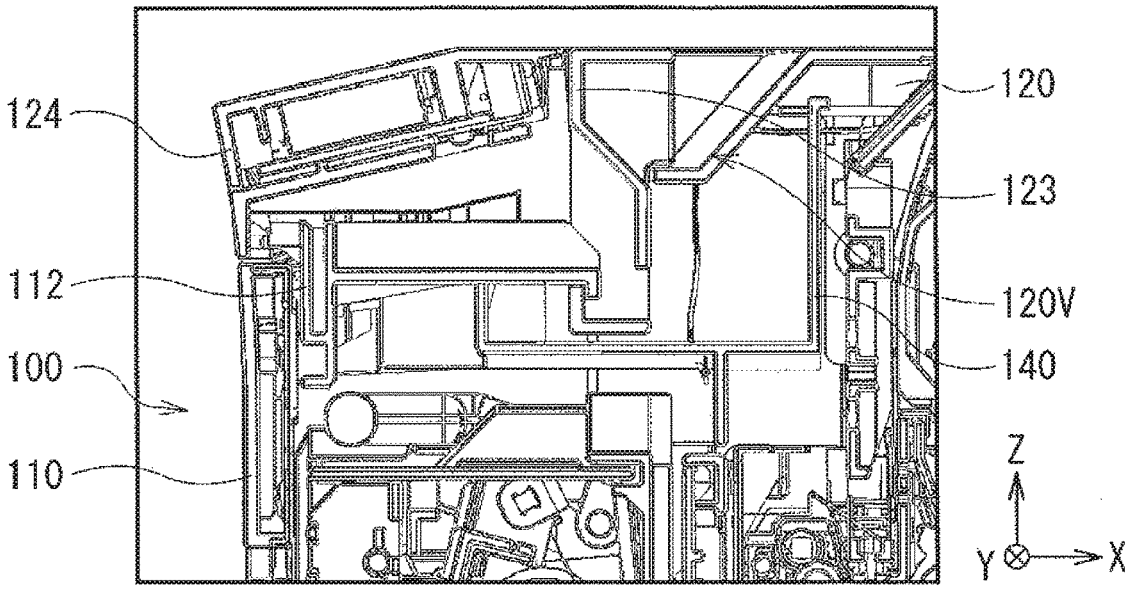
FIG. 5 is a diagram illustrating a partial plan view, taken along the line A-A of FIG. 1, of the configuration of the image forming apparatus.
Figure 6:
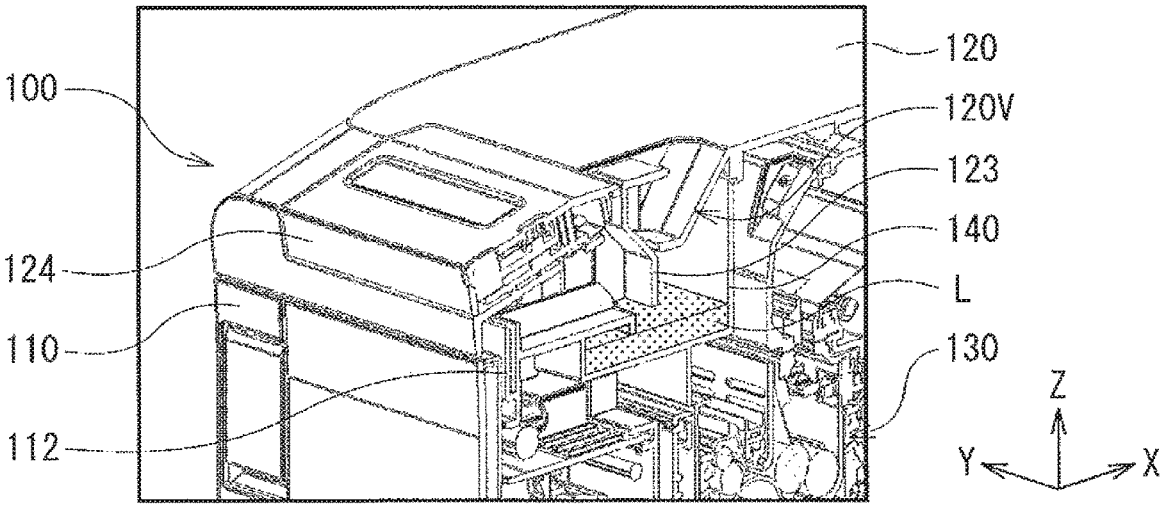
FIG. 6 is a diagram illustrating a partial perspective view, taken along the line A-A of FIG. 1, of the configuration of the image forming apparatus.

FIG. 5 is a diagram illustrating a partial plan view taken along the line A-A of FIG. 1, of the configuration of the image forming apparatus, while FIG. 6 is a diagram illustrating a partial perspective view taken along the line A-A of FIG. 1, of the configuration of the image forming apparatus. Note that FIGS. 5 and 6 both illustrate a state where the image forming apparatus is sectioned along the line A-A. Also, FIG. 6 illustrates a state where a liquid L is housed in the liquid guidance case 140 with the liquid L indicated by hatching.

Figure 7:
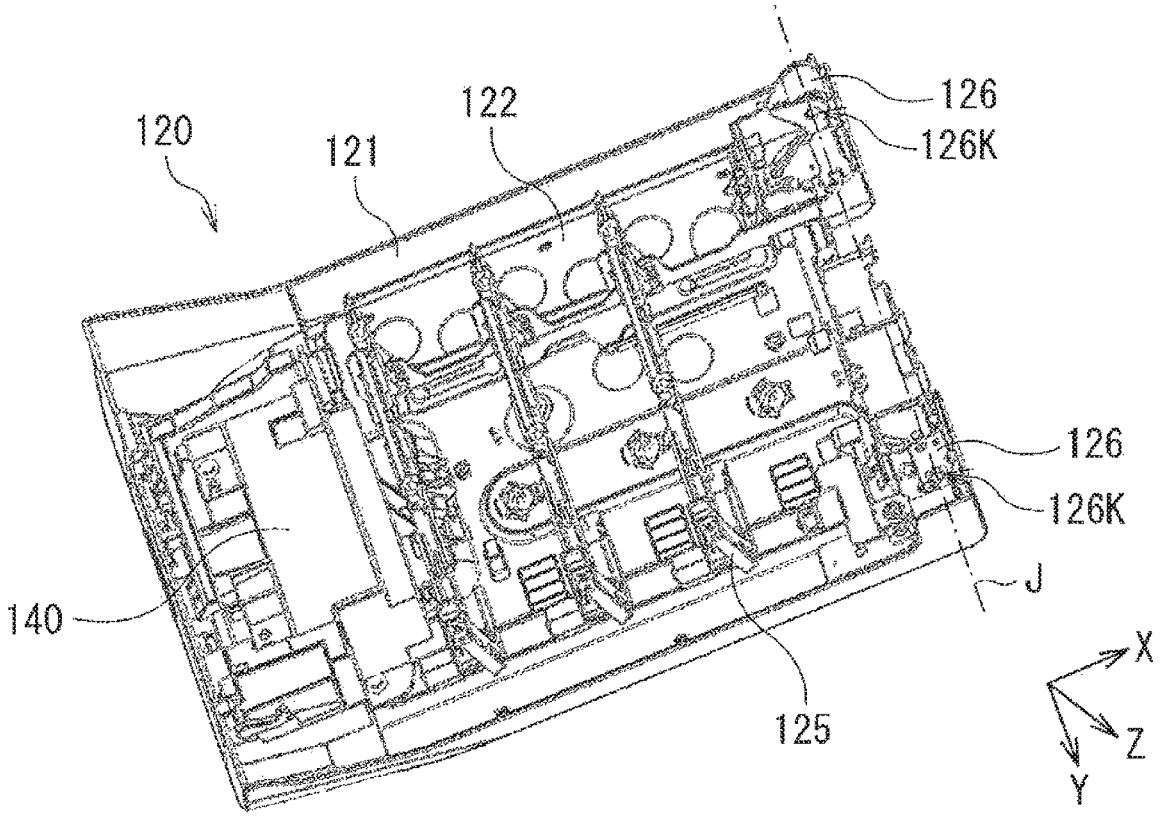
FIG. 7 is a diagram illustrating a perspective view of a configuration of the top cover illustrated in FIG. 2.
Figure 8:
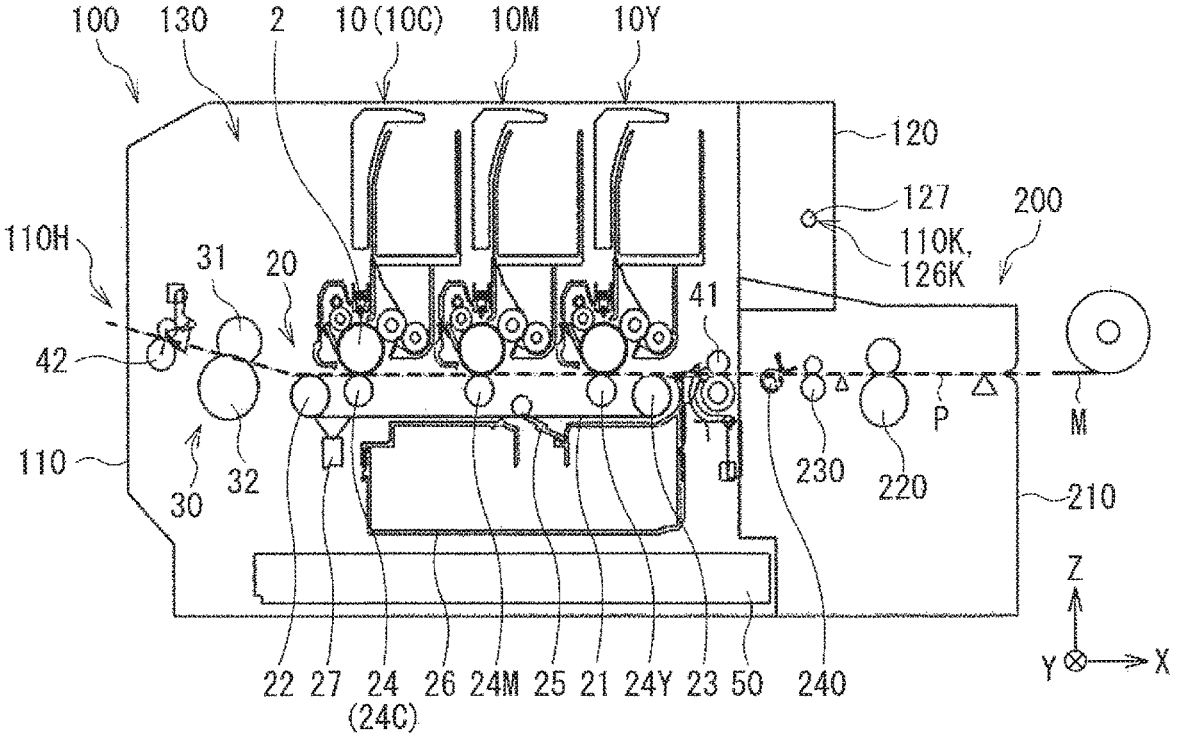
FIG. 8 is a schematic diagram illustrating a plan view of the configuration of the image forming apparatus illustrated in FIG. 1.

FIG. 7 is a diagram illustrating a perspective view of a configuration of the top cover 120 illustrated in FIG. 2. FIG. 8 is a diagram illustrating a plan view schematically illustrating the configuration of the image forming apparatus illustrated in FIG. 1. Note that FIG. 7 illustrates a state where the top cover 120 is removed from a housing 110. Also, in FIG. 8, the illustration of the housing 110 and the top cover 120 is simplified, and a conveyance path P of the medium M is indicated by the broken line.

In the following description, it is assumed that the upper side, lower side, left side, and right side of the image forming apparatus illustrated in FIGS. 1 and 2 are the upper side, lower side, front side, and rear side, respectively.

As illustrated in FIGS. 1 to 8, the image forming apparatus includes, for example, an image forming unit 100 and a paper feed unit 200.

[Image Forming Unit]

The image forming unit 100 forms an image on the medium M by using the medium M fed by the paper feed unit 200.

The image forming unit 100 includes, for example, an image forming device 130 inside the housing 110 with the top cover 120 attached thereto, and the top cover 120 includes the liquid guidance case 140. More specifically, the liquid guidance case 140 is a part of the top cover 120. Here, the housing 110 may be referred to as a "housing" according to an aspect of one or more embodiments of the disclosure. The top cover 120 may be referred to as a "cover" according to an aspect of one or more embodiments of the disclosure. The image forming device 130 may be referred to as an "image forming part" according to an aspect of one or more embodiments of the disclosure. The liquid guidance case 140 may be referred to as a "liquid receiver" according to an aspect of one or more embodiments of the disclosure.

(Housing)

The housing 110 is, for example, a box-shaped member with an opening on the upper side, that is, on the side where the top cover 120 is disposed, and houses the image forming device 130.

The housing 110 includes, for example, a discharge opening 110H. The discharge opening 110H is an opening for discharging the medium M with an image formed thereon to the outside of the image forming apparatus (housing 110), and is provided, for example, at the front of the housing 110.

Figure 13:
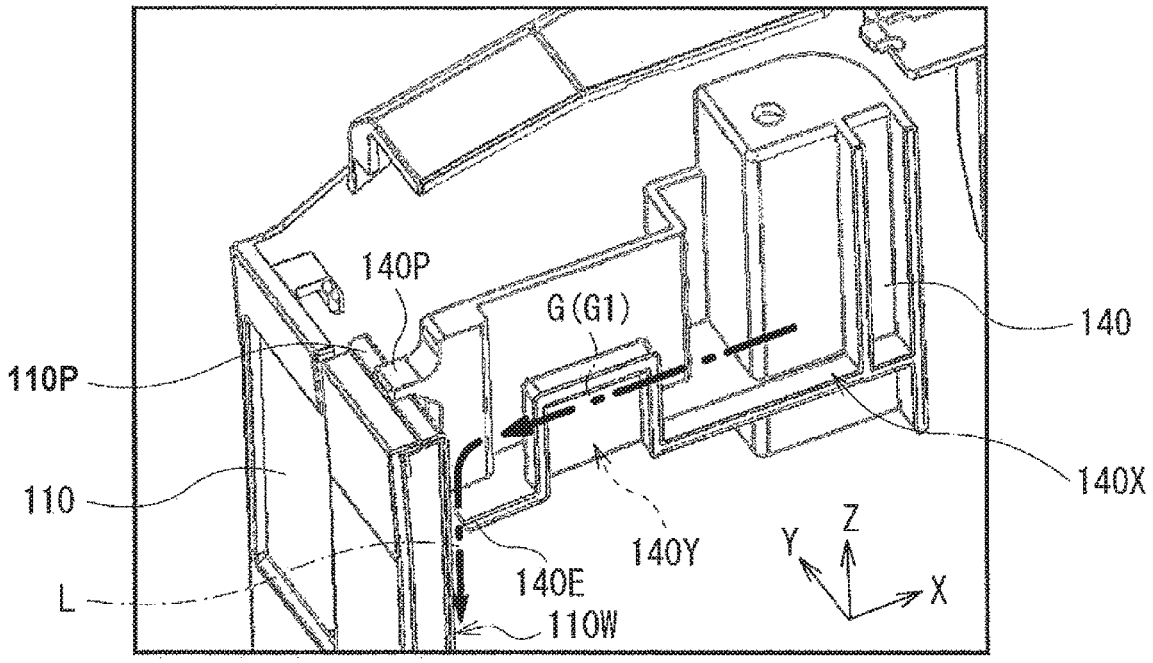
FIG. 13 is a diagram illustrating a partial perspective view, taken along the line B-B of FIG. 4, of the configuration of the image forming apparatus.

The housing 110 also includes an inner wall surface 110W as described later (see FIGS. 13 and 14). To be more specific, the housing 110 includes, for example, an inner wall plate 110P attached to the inside of the front thereof, and the inner wall surface 110W described above is, for example, a surface (inner surface) of the inner wall plate 110P.

Note that the housing 110 includes, for example, a lever receiver 112. This lever receiver 112 is a member to be engaged with an opening and closing lever 123 to be described later. Note that, at a rear end of the housing 110 (for example, a distal end from an operation panel 124), a through-hole 110K is provided, for example, in a spot corresponding to a through-hole 126K provided in a rib 126 to be described later. This through-hole 110K extends, for example, in a Y-axis direction, and a shaft 127 to be described later is inserted into the through-hole 110K, for example.

(Top Cover)

The top cover 120 is a plate-like member attached to the opening of the housing 110 in which the image forming device 130 is housed. This top cover 120 is movably attached to the housing 110, that is, is movable between a position close to the housing 110 and a position away from the housing 110.

To be more specific, the top cover 120 is, for example, openable and closeable. More specifically, the top cover 120 is, for example, opened by being moved close to the housing 110 and closed by being moved away from the housing 110. In the following description, a state where the top cover 120 is close to the housing 110 is referred to as a "state where the top cover 120 is closed", while a state where the top cover 120 is away from the housing 110 is referred to as a "state where the top cover 120 is opened".

The top cover 120 includes, for example, a cover main body 121, a reinforcing plate 122, the opening and closing lever 123, the operation panel 124, a head holder 125, the rib 126, the shaft 127, and the liquid guidance case 140. Here, the cover main body 121 may be referred to as a "cover main body part" according to an aspect of one or more embodiments of the disclosure.

The cover main body 121 is a plate-like member that is the main body of the top cover 120. The liquid guidance case 140 is, for example, fixed to the cover main body 121 and thus supported by the cover main body 121. Note, however, that the liquid guidance case 140 may be, for example, fixed to the reinforcing plate 122. This cover main body 121 is, for example, movable relative to the housing 110, and thus the top cover 120 including the cover main body 121 is movable, for example, according to a moving operation of the cover main body 121.

The reinforcing plate 122 is a plate-like member to reinforce the physical strength of the cover main body 121. This reinforcing plate 122 is provided, for example, on the inside of the cover main body 121, and contains a material having a higher rigidity than the cover main body 121.

The opening and closing lever 123 is a grip member used to open and close the top cover 120, which is provided on the outside of the top cover 120. This opening and closing lever 123 is disposed, for example, inside a lever opening 120V provided in the top cover 120, and can be engaged with the housing 110 (lever receiver 112). The top cover 120 is fixed to the housing 110 by engaging the opening and closing lever 123 with the lever receiver 112. More specifically, with the opening and closing lever 123 engaged with the lever receiver 112, the opening of the housing 110 is closed by the top cover 120 since the opening and closing lever 123 is fixed to the lever receiver 112. On the other hand, with the opening and closing lever 123 not engaged with the lever receiver 112, the top cover 120 can be opened since the opening and closing lever 123 is released from the lever receiver 112. Here, the opening and closing lever 123 may be referred to as an "engagement unit" according to an aspect of one or more embodiments of the disclosure.

The operation panel 124 is, for example, an input device used to cause the image forming device 130 to form an image, that is, used by a user to form an image on the medium M with the image forming apparatus. This operation panel 124 is provided, for example, on the outside of the top cover 120, more specifically, on the front upper surface of the cover main body 121. Here, the operation panel 124 may be referred to as an "operation unit" according to an aspect of one or more embodiments of the disclosure.

The head holder 125 is a plate-like member that supports a developing unit 10 or a developing device to be described later, in a state where the top cover 120 is closed. This head holder 125, for example, extends in the Y-axis direction and also protrudes in a Z-axis direction, and is provided on the inside of the cover main body 121. The number of the head holders 125 is not particularly limited but, for example, corresponds to the number of the developing units 10. Here, for example, the number of the developing units 10 is 3 as described later, and thus the number of the head holders 125 is also 3. The three head holders 125 are arranged in an X-axis direction, for example, while being spaced away from each other.

The rib 126 is a protruding member used to pivot the top cover 120 (cover main body 121). This rib 126 protrudes, for example, in the Z-axis direction, and is provided on the inside of the cover main body 121. For example, the through-hole 126K extending in the Y-axis direction is provided in the rib 126. The number of the ribs 126 is not particularly limited but is, for example, 2. These two ribs 126 are disposed, for example, at the rear end of the cover main body 121 (distal end from the operation panel 124) and arranged in the Y-axis direction while being spaced away from each other.

The shaft 127 is a rod-shaped member used to pivot the top cover 120 (cover main body 121) in a pivot direction R, and extends in a direction (Y-axis direction) intersecting with an opening and closing direction (pivot direction R) of the top cover 120. This shaft 127 is inserted, for example, into both of the through-hole 110K provided in the housing 110 and the through-hole 126K provided in the rib 126, and thus inserted into the housing 110 and the top cover 120 (rib 126), respectively. Here, since the number of the ribs 126 is, for example, 2, the shaft 127 is inserted, for example, from one through-hole 126K to the other through-hole 126K via the through-hole 110K. Thus, the top cover 120 can pivot about the shaft 127, for example, in the pivot direction R. More specifically, the top cover 120 has a pivot shaft J, for example, that extends in the Y-axis direction and is used to pivot the top cover 120, and can be opened and closed by pivoting about the pivot shaft J.

The liquid guidance case 140 is a container-shaped member with an opening on the upper side, that is, on the side closer to the top cover 120, and receives the liquid L (FIG. 6) getting into the housing 110. This liquid guidance case 140 is particularly brought close to the inner wall surface 110W of the housing 110 in a state where the top cover 120 is closed, as described later. On the other hand, the liquid guidance case 140 is, for example, brought away from the inner wall surface 110W in a state where the top cover 120 is opened, as described later.

To be more specific, the liquid guidance case 140 houses the liquid L, for example, by receiving the liquid L getting into the image forming apparatus (housing 110) through the top cover 120 in a state where the top cover 120 is closed. Therefore, the liquid guidance case 140 is housed inside the housing 110 and disposed above the image forming device 130, that is, positioned between the top cover 120 and the image forming device 130, in the state where the top cover 120 is closed. Accordingly, the liquid guidance case 140 guides the liquid L toward the inner wall surface 110W once the liquid L getting into the housing 110 is housed therein. More specifically, the liquid L is guided by the liquid guidance case 140 to a position away from the image forming device 130. Note that the configuration of the liquid guidance case 140 is described later (see FIGS. 10 to 14).

The kind of the liquid L getting into the housing 110 is not particularly limited but is, for example, rain, drinking water, domestic water, or the like.

The reason why the liquid L gets into the housing 110 through the top cover 120 is not particularly limited but includes, for example, entry of the liquid L through the lever opening 120V in which the opening and closing lever 123 is disposed, entry of the liquid L through the operation panel 124, and the like.

(Image Forming Device)

The image forming device 130 forms an image on the medium M with the toner T. Note that the configuration of the image forming device 130 is described later.

[Paper Feed Unit]

The paper feed unit 200 feeds the medium M to the image forming unit 100. To be more specific, the paper feed unit 200 feeds the medium M to the image forming unit 100, for example, by conveying the medium M along the conveyance path P after cutting the medium M wound up in a roll shape.

The paper feed unit 200 is installed, for example, behind the image forming unit 100, and includes conveyance rollers 220 and 230 and a cutter 240 inside the housing 210. The conveyance rollers 220 and 230 and the cutter 240 are arranged in this order, for example, from the upstream side to the downstream side in the conveyance path P.

The conveyance rollers 220 and 230 each include a pair of rollers disposed facing each other across the conveyance path P to convey the medium M wound up in the roll shape toward the cutter 240. The pair of rollers are, for example, cylindrical members that extend in the Y-axis direction and can be rotated about a rotation axis extending in the Y-axis direction. Among constituent components of the image forming apparatus to be described later, those with the word "roller" in their names are cylindrical members that extend and can be rotated in the same manner as the pair of rollers described above.

The cutter 240 is a member that cuts the medium M wound up in the roll shape into pieces each having a predetermined dimension (length). This cutter 240 is, for example, a rotary cutter and thus can cut the medium M wound up in the roll shape while conveying the medium M.

<1-2. Configuration of Image Forming Device>

Next, the configuration of the image forming device 130 is described.

Figure 9:
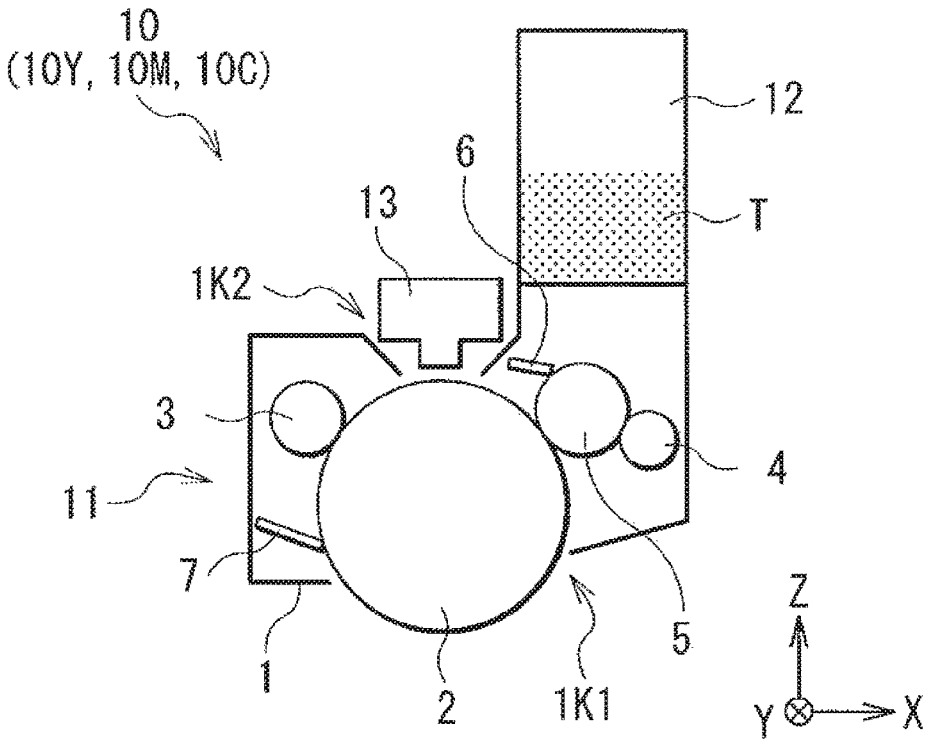
FIG. 9 is a schematic diagram illustrating an enlarged plan view of a configuration of a developing unit illustrated in FIG. 8.

FIG. 9 is a diagram illustrating an enlarged plan view schematically illustrating a configuration of the developing unit 10 illustrated in FIG. 8. In the following description, reference is made not only to FIG. 9 but also to FIG. 8 as needed.

As illustrated in FIGS. 8 and 9, the image forming device 130 includes, for example, the developing unit 10, a transfer unit 20, a fixing unit 30, conveyance rollers 41 and 42, and a control board 50. The medium M to be fed to the image forming unit 100 (image forming device 130) from the paper feed unit 200 is conveyed along the conveyance path P as described above. Here, the fixing unit 30 functions as a fixing device may be referred to as a "fixing unit" according to an aspect of one or more embodiments of the disclosure.

[Developing Unit]

The developing unit 10 performs adhesion processing (development processing) of the toner T to an electrostatic latent image. To be more specific, the developing unit 10 forms an electrostatic latent image, for example, and uses coulomb force to cause the toner T to adhere to the electrostatic latent image. With the top cover 120 closed, the head holder 125 is disposed along the developing unit 10, for example, and thus the developing unit 10 is supported by the head holder 125, for example.

Here, the image forming device 130 includes, for example, three developing units 10 (10Y, 10M, and 10C). The developing units 10Y, 10M, and 10C are attachable to and detachable from the housing 110, and are arranged along the conveyance path P. Here, the developing units 10Y, 10M, and 10C are arranged, for example, in this order from the upstream side to the downstream side of the conveyance path P.

The developing units 10Y, 10M, and 10C each include, for example, a development processor 11 and a toner cartridge 12 as illustrated in FIG. 9. The toner cartridge 12 is, for example, attachable to and detachable from the development processor 11. More specifically, the developing units 10Y, 10M, and 10C all have the same configuration, for example, except for having a different kind (color) of the toner T housed in the toner cartridge 12. Note that a light source 13 is attached, for example, to the development processor 11.

The development processor 11 uses the toner T supplied from the toner cartridge 12 to perform development processing. This development processor 11 includes, for example, a photoconductor drum 2, a charging roller 3, a feed roller 4, a developing roller 5, a developing blade 6, and a cleaning blade 7 in a housing 1.

An opening 1K1 for partially exposing the photoconductor drum 2 and an opening 1K2 for guiding light outputted from the light source 13 to the photoconductor drum 2 are provided, for example, in the housing 1. For example, the light source 13 is disposed outside the housing 1 and supported by the head holder 125.

The photoconductor drum 2 is an organic photoconductor carrying an electrostatic latent image, and is a rotatable cylindrical member extending in the same manner as the conveyance rollers 220 and 230 described above. The charging roller 3 is pressure contacted to the photoconductor drum 2 to charge the surface of the photoconductor drum 2. The feed roller 4 is pressure contacted to the developing roller 5 to feed the toner T to the surface of the developing roller 5. The developing roller 5 is pressure contacted to the photoconductor drum 2 to carry the toner T fed from the feed roller 4 and to cause the toner T to adhere to the electrostatic latent image formed on the surface of the photoconductor drum 2.

The developing blade 6 is a plate-like member that regulates the thickness of the toner T fed onto the surface of the developing roller 5. This developing blade 6 is disposed, for example, at a position away from the developing roller 5 by a predetermined distance, and controls the thickness of the toner T according to the distance (interval) between the developing roller 5 and the developing blade 6.

The cleaning blade 7 is a plate-like elastic member to scrape off a foreign object such as unwanted toner T remaining on the surface of the photoconductor drum 2. This cleaning blade 7 extends, for example, in a direction approximately parallel to the extending direction of the photoconductor drum 2, and is pressure contacted to the photoconductor drum 2.

The toner cartridge 12 is a member that houses the toner T. The toner cartridge 12 of the developing unit 10Y houses, for example, a yellow toner. The toner cartridge 12 of the developing unit 10M houses, for example, a magenta toner. The toner cartridge 12 of the developing unit 10C houses, for example, a cyan toner.

The light source 13 is an exposure device that forms an electrostatic latent image on the surface of the photoconductor drum 2 by exposing the surface of the photoconductor drum 2. This light source 13 is, for example, an LED head including a light-emitting diode (LED) element, a lens array, and the like. The LED element and the lens array are arranged, for example, such that light outputted from the LED element forms an image on the surface of the photoconductor drum 2.

[Transfer Unit]

The transfer unit 20 performs transfer processing with the toner T developed by the developing unit 10. To be more specific, the transfer unit 20 transfers, for example, the toner T caused to adhere to the electrostatic latent image by the developing unit 10 onto the medium M.

The transfer unit 20 includes, for example, a conveyance belt 21, a driving roller 22, a driven roller 23, a transfer roller 24, a cleaning blade 25, a collection box 26, and a sensor 27.

The conveyance belt 21 is a belt to convey the medium M, which is, for example, an endless elastic belt. This conveyance belt 21 can be moved, for example, in response to rotation of the driving roller 22 while being stretched by the driving roller 22 and the driven roller 23. The driving roller 22 can be rotated, for example, by using power such as a motor, while the driven roller 23 can be rotated, for example, in response to the rotation of the driving roller 22.

The transfer roller 24 is pressure contacted to the photoconductor drum 2 through the conveyance belt 21 to transfer the toner T adhering to the electrostatic latent image onto the medium M. The number of the transfer rollers 24 is not particularly limited but, for example, corresponds to the number of the developing units 10. Here, the number of the developing units 10 is 3 (10Y, 10M, and 10C), for example, and thus the number of the transfer rollers 24 is also 3 (24Y, 24M, and 24C).

The cleaning blade 25 is pressure contacted to the conveyance belt 21 to scrape off a foreign object such as unwanted toner T remaining on the surface of the conveyance belt 21. The collection box 26 collects the foreign object scraped off by the cleaning blade 25. The sensor 27 includes, for example, a photosensor to detect whether or not an image is formed on the medium M, the density of the image, and the like. Note, however, that the type (role) of the sensor 27 is not particularly limited.

[Fixing Unit]

The fixing unit 30 performs fixing processing with the toner T transferred onto the medium M by the transfer unit 20. To be more specific, the fixing unit 30 fixes the toner T to the medium M by heating and pressurizing the medium M with the toner T transferred thereon by the transfer unit 20.

The fixing unit 30 includes, for example, a heating roller 31 and a pressure roller 32. The heating roller 31 heats the toner T transferred onto the medium M. A heat source such as a heater, for example, is installed inside the heating roller 31, and a temperature measuring element such as a thermistor is disposed, for example, away from the heating roller 31, near the heating roller 31. The pressure roller 32 is pressure contacted to the heating roller 31 to pressurize the toner T transferred onto the medium M.

[Conveyance Roller]

The conveyance rollers 41 and 42 both have the same configuration as that of the conveyance rollers 220 and 230, and convey the medium M along the conveyance path P. The conveyance belt 21 is disposed, for example, between the conveyance rollers 41 and 42.

[Control Board]

The control board 50 includes, for example, a central processing unit (CPU) or a processor and the like to control the entire image forming apparatus.

<1-3. Configuration of Liquid Guidance Case>

Next, the configuration of the liquid guidance case 140 is described.

Figure 10:
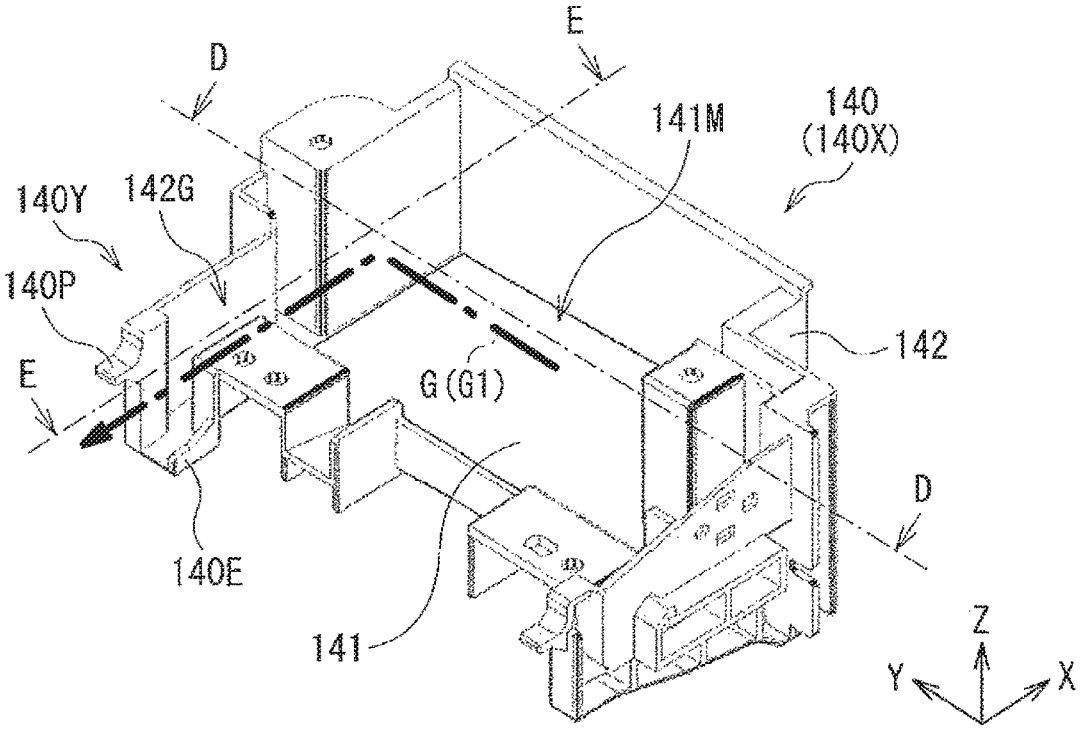
FIG. 10 is a diagram illustrating a perspective view of a configuration of a liquid guidance case illustrated in FIG. 2.
Figure 11:
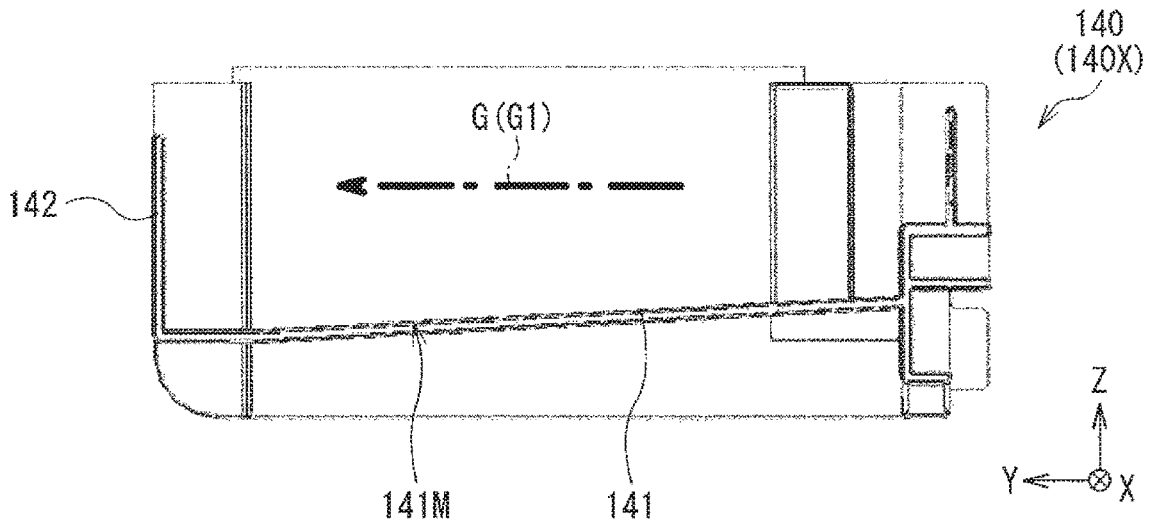
FIG. 11 is a diagram illustrating a plan view, taken along the line D-D of FIG. 10, of the configuration of the liquid guidance case.
Figure 12:
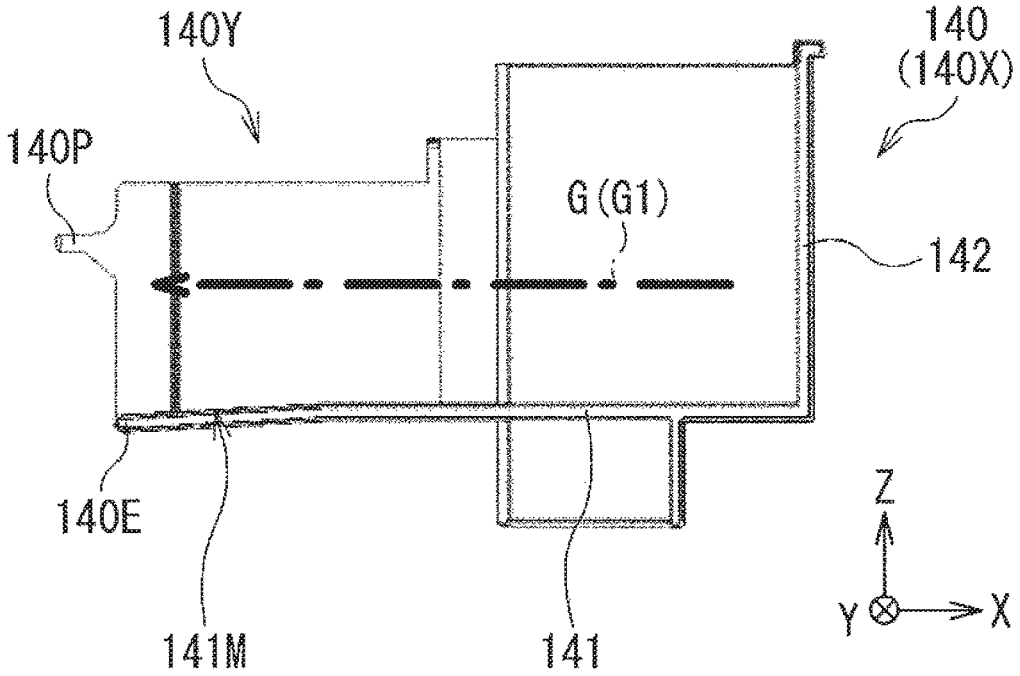
FIG. 12 is a diagram illustrating a plan view, taken along the line E-E of FIG. 10, of the configuration of the liquid guidance case.

FIG. 10 is a diagram illustrating a perspective view of the configuration of the liquid guidance case 140 illustrated in FIG. 2. FIG. 11 is a diagram illustrating a plan view taken along the line D-D of FIG. 10, of the configuration of the liquid guidance case 140. FIG. 12 is a diagram illustrating a plan view taken along the line E-E of FIG. 10, of the configuration of the liquid guidance case 140. FIG. 13 is a diagram illustrating a partial perspective view taken along the line B-B of FIG. 4, of the configuration of the image forming apparatus. FIG. 14 is a diagram illustrating a partial perspective view taken along the line C-C of FIG. 4, of the configuration of the image forming apparatus.

Note that FIG. 11 illustrates a state where the image forming apparatus is sectioned along the line D-D, while FIG. 12 illustrates a state where the image forming apparatus is sectioned along the line E-E. FIG. 13 illustrates a state where the image forming apparatus is sectioned along the line B-B, while FIG. 14 illustrates a state where the image forming apparatus is sectioned along the line C-C. In the following description, reference is made not only to FIGS. 10 to 14 but also to FIGS. 1 to 6 as needed.

As illustrated in FIGS. 1 to 6 and FIGS. 10 to 14, the liquid guidance case 140 that is a part of the top cover 120 is disposed, for example, such that the opening faces upward inside the housing 110 in a state where the top cover 120 is closed. This liquid guidance case 140 is disposed, for example, on the opposite side (front side) to the side (rear side) where the pivot shaft J is disposed, when the top cover 120 can pivot about the pivot shaft J.

With the top cover 120 closed, for example, the cover main body 121 is disposed above the liquid guidance case 140, and the image forming device 130 is disposed below the liquid guidance case 140. Thus, the liquid guidance case 140 prevents the liquid L from reaching the image forming device 130 by receiving the liquid L getting into the housing 110 from above the housing 110, that is, the liquid L getting into the housing 110 through the top cover 120.

In this case, the liquid guidance case 140 is disposed above the fixing unit 30, to be more specific, preferably disposed to partially or fully overlap with the fixing unit 30. More specifically, the liquid guidance case 140 is preferably positioned between the top cover 120 and the fixing unit 30. This is because such a configuration prevents the liquid L from reaching the fixing unit 30 that requires heat treatment by the heating roller 31, thus making it unlikely for the heat treatment to be hindered by the liquid L. That is, unintended reduction in heating temperature caused by the liquid L touching the heating roller 31 is prevented, thus making it easier for the fixing unit 30 to stably execute the fixing processing.

As described above, the liquid guidance case 140 not only prevents the liquid L from reaching the image forming device 130 by housing the liquid L but also guides the liquid L to get away from the image forming device 130. More specifically, the liquid guidance case 140 guides the liquid L toward the inner wall surface 110W along a guidance path G, thereby keeping the liquid L away from the image forming device 130.

To be more specific, the liquid guidance case 140 includes, for example, a bottom part 141 and a wall part 142, as illustrated in FIGS. 10 to 12.

The bottom part 141 includes, for example, a bottom surface 141M that receives the liquid L, on the side where the liquid L is housed in the liquid guidance case 140. This bottom surface 141M is tilted, for example, in the guidance path G, to be more specific, tilted to gradually get lower along a direction of guiding the liquid L (toward the inner wall surface 110W). More specifically, the bottom surface 141M is tilted, for example, to gradually get lower along the direction of guiding the liquid L in the Y-axis direction (see FIG. 11) and also tilted to gradually get lower along the direction of guiding the liquid L in the X-axis direction (see FIG. 12). Thus, the liquid guidance case 140 can smoothly and stably guide the liquid L to the inner wall surface 110W, for example, by utilizing the tilt of the bottom surface 141M described above.

The wall part 142 is connected to the bottom part 141, for example, while surrounding the bottom part 141. This wall part 142 includes, for example, a guidance opening 142G for guiding the liquid L toward the inner wall surface 110W. The bottom part 141 and the wall part 142 are partially extended, for example, toward the inner wall surface 110W in a spot where the guidance opening 142G is provided. Thus, the liquid guidance case 140 includes, for example, a container 140X that houses the liquid L, and a guidepath 140Y that is connected to the container 140X and extends toward the inner wall surface 110W. More specifically, the liquid guidance case 140 can guide the liquid L toward the inner wall surface 110W through the guidepath 140Y, for example, after housing the liquid L in the container 140X. Therefore, the guidepath 140Y is brought close to (is adjacent to) the inner wall surface 110W, for example, in a state where the top cover 120 is closed.

Particularly, the liquid guidance case 140 includes, for example, a protrusion 140P and a guidance end 140E, as illustrated in FIGS. 10 to 14.

The protrusion 140P is provided, for example, in the upper front of the liquid guidance case 140 (guidepath 140Y) and protrudes forward beyond the inner wall surface 110W. This protrusion 140P fixes the position of the liquid guidance case 140 in the Z-axis direction, for example, by coming into contact with the inner wall plate 110P in the state where the top cover 120 is closed.

The guidance end 140E is, for example, a lower front end of the liquid guidance case 140, which is a substantial front end of the path for guiding the liquid L. Since the liquid guidance case 140 is brought close to (is adjacent to) the inner wall surface 110W in the state where the top cover 120 is closed as described above, the guidance end 140E is away from the inner wall surface 110W rather than being in contact with the inner wall surface 110W in the state where the top cover 120 is closed. The distance by which the guidance end 140E is away from the inner wall surface 110W, that is, a distance (clearance L) between the guidance end 140E and the inner wall surface 110W is not particularly limited but is, for example, 3 mm or less in an embodiment. It may be preferable that the distance is in a range of 1 mm to 5 mm, and may be more preferable that the distance is in a range of 2 mm to 4 mm.

<1-4. Operations>

Next, operations of the image forming apparatus are described. Hereinafter, with reference to FIGS. 1 to 14, an operation of forming an image is described and then an operation of guiding the liquid L is described.

[Image Formation Operation]

To form an image on the medium M, the image forming apparatus (see FIGS. 8 and 9) performs development processing, transfer processing, and fixing processing in this order, for example, as described below, and also performs cleaning processing as needed. Such a series of processing is controlled, for example, by the control board 50.

(Development Processing)

The paper feed unit 200 cuts the medium M wound up in a roll shape with a cutter 240, and then feeds the cut medium M to the image forming unit 100.

In the development processing, when the photoconductor drum 2 is rotated in the developing unit 10 (development processor 11), a direct-current voltage is applied to the photoconductor drum 2 in response to the rotation of the charging roller 3, and thus the photoconductor drum 2 is evenly charged. Then, when the light source 13 irradiates the photoconductor drum 2 with light based on image data, the potential is attenuated (optically attenuated) in an irradiation region of the light, and thus an electrostatic latent image is formed. This image data is transmitted, for example, to the image forming apparatus from an external device such as a personal computer.

In the development processor 11, the feed roller 4 and the developing roller 5 are rotated in response to the voltage application, and thus the toner T is fed from the feed roller 4 to the developing roller 5. Meanwhile, when the photoconductor drum 2 is rotated, the toner T is moved from the developing roller 5 to the photoconductor drum 2, and thus adheres to the photoconductor drum 2 (electrostatic latent image). In this case, the developing blade 6 removes a part of the toner T to achieve a uniform thickness of the toner T.

Meanwhile, in the developing unit 10 (toner cartridge 12), the toner T is stirred and thus fed from the toner cartridge 12 to the development processor 11. Although the toner T is illustrated only inside the toner cartridge 12 in FIG. 9, the toner T may also be present inside the development processor 11 (housing 1).

(Transfer Processing)

In the transfer unit 20, when the driving roller 22 is rotated, the driven roller 23 is rotated in response to the rotation of the driving roller 22 to move the conveyance belt 21. In the transfer processing, the transfer roller 24 is pressure contacted to the photoconductor drum 2 through the conveyance belt 21. Therefore, when a voltage is applied to the transfer roller 24, the toner T caused to adhere to the photoconductor drum 2 by the development processing is transferred onto the medium M.

(Fixing Processing)

In the fixing processing, the medium M passes between the heating roller 31 and the pressure roller 32 in the fixing unit 30. In this case, the toner T transferred onto the medium M is heated by the heating roller 31 to be melted, and the melted toner T is pressure contacted to the medium M by the pressure roller 32. Thus, the toner T adheres to the medium M.

Accordingly, the toner T is fixed to the medium M, and thus an image is formed on the medium M. The medium M having the image formed thereon is discharged from the discharge opening 110H. Note that the kinds and the number of the toners T used to form an image are determined according to a combination of colors required to form the image.

(Cleaning Processing)

In the developing unit 10, since the photoconductor drum 2 is rotated in pressure contact with the cleaning blade 7, a foreign object such as unwanted toner T remaining on the surface of the photoconductor drum 2 is scraped off by the cleaning blade 7.

Meanwhile, in the transfer unit 20, a foreign object such as unwanted toner T remaining on the surface of the conveyance belt 21 is scraped off by the cleaning blade 25 while the conveyance belt 21 is moved. Thus, the foreign object is collected into the collection box 26.

[Liquid Guiding Operation]

When the liquid L gets into the image forming apparatus, the liquid L is guided toward the inner wall surface 110W by the liquid guidance case 140 as described below. Hereinafter, description is given of a case where the liquid L gets into the housing 110, for example, from the lever opening 120V in which the opening and closing lever 123 is disposed.

In a state where the top cover 120 is closed (see FIGS. 1 and 3), the liquid guidance case 140 that is a part of the top cover 120 is disposed such that the opening faces upward inside the housing 110, as illustrated in FIGS. 4 to 6. In this case, the liquid guidance case 140 is disposed above the image forming device 130, to be more specific, above the fixing unit 30, for example. Also, the protrusion 140P comes into contact with the housing 110 (inner wall plate 110P), and thus the position of the liquid guidance case 140 is fixed in the Z-axis direction.

When the liquid L is supplied over the image forming apparatus for some reason, the liquid L gets into the housing 110 through the top cover 120 (lever opening 120V). In this case, the liquid guidance case 140 is disposed below the top cover 120, and thus the liquid L is housed inside (the container 140X) of the liquid guidance case 140, as illustrated in FIGS. 6 and 10.

When the liquid L is housed in the container 140X, the liquid guidance case 140 guides the liquid L toward the inner wall surface 110W through the guidepath 140Y from the container 140X by utilizing the tilt of the bottom surface 141M, as illustrated in FIG. 6 and FIGS. 10 to 14. Thus, the liquid L is guided to get away from the fixing unit 30 along the guidance path G.

Figure 14:
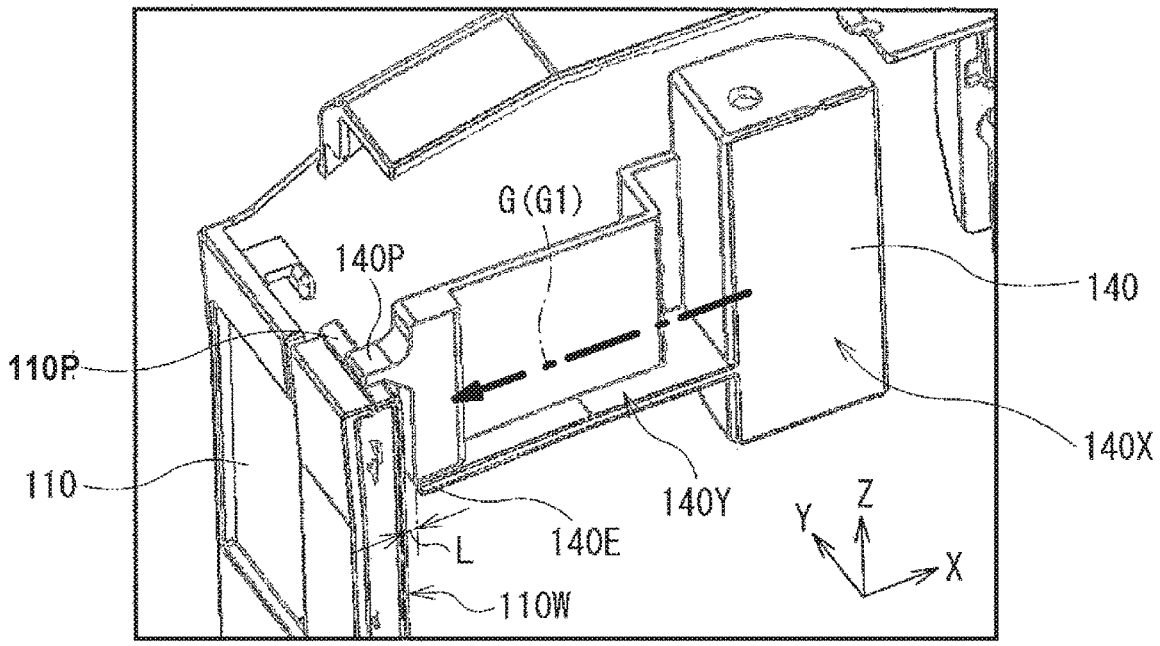
FIG. 14 is a diagram illustrating a partial perspective view, taken along the line C-C of FIG. 4, of the configuration of the image forming apparatus.

The guidance end 140E of the liquid guidance case 140 is slightly away from the housing 110 (inner wall surface 110W), to be more specific, retreated from the inner wall surface 110W by the clearance L, as illustrated in FIG. 14. Thus, the liquid L guided to the guidance end 140E flows downward along the inner wall surface 110W as illustrated in FIG. 13. Accordingly, the liquid L getting into the image forming apparatus is housed in the liquid guidance case 140 and then discharged from the liquid guidance case 140 without reaching the image forming device 130 (fixing unit 30).

<1-5. Advantageous Effects>

In the image forming apparatus according to this embodiment, the image forming device 130 is housed inside the housing 110, and the top cover 120 attached in a movable (openable and closable) manner to the housing 110 includes the liquid guidance case 140. This liquid guidance case 140 is brought close to the inner wall surface 110W of the housing 110 in a state where the top cover 120 is closed.

In this case, as described above, when the liquid L gets into the housing 110 in the state where the top cover 120 is closed, the liquid L is housed in the liquid guidance case 140 and then guided toward the inner wall surface 110W by the liquid guidance case 140. This prevents the liquid L from reaching the image forming device 130, thus making the image forming device 130 free of problem caused by the contact with the liquid L. Therefore, even when the liquid L gets unintentionally into the housing 110, the image forming device 130 is allowed to stably keep performing the image formation operation.

At the same time, the liquid guidance case 140 is a part of the top cover 120, and thus can be moved in response to a moving operation of the top cover 120. Thus, when the top cover 120 is closed, the liquid guidance case 140 is brought close to the inner wall surface 110W in the housing 110 as described above. Therefore, when the liquid L is supplied above the image forming apparatus (top cover 120), the liquid L getting into the housing 110 through the top cover 120 can be housed in the liquid guidance case 140. On the other hand, when the top cover 120 is opened as needed, the liquid guidance case 140 is detached from the housing 110 in response to the moving operation of the top cover 120, and thus the liquid guidance case 140 is away from the inner wall surface 110W. Therefore, the liquid guidance case 140 is removed from the inside of the housing 110 just by opening the top cover 120. In this case, maintenance of the image forming device 130, and the like can be performed, for example, without having to go to the trouble of removing the liquid guidance case 140.

For these reasons, occurrence of problems with the image forming device 130 due to the entry of the liquid L can be prevented by using the liquid guidance case 140 while avoiding the liquid guidance case 140 from getting in the way of the maintenance of the image forming device 130 or the like. Therefore, maintenance of the image forming apparatus, and the like are facilitated while achieving the stable image formation operation by the image forming device 130. Thus, the convenience of the image forming apparatus in use can be enhanced.

Particularly, if the bottom surface 141M of the liquid guidance case 140 is tilted to gradually get lower toward the inner wall surface 110W, the use of such a tilt of the bottom surface 141M makes it easier to guide the liquid L toward the inner wall surface 110W, thus allowing for more advantageous effects.

Moreover, with the liquid guidance case 140 including the guidepath 140Y and the guidepath 140Y brought close to the inner wall surface 110W in a state where the top cover 120 is closed, the use of the guidepath 140Y makes it easier to guide the liquid L toward the inner wall surface 110W, thus allowing for more advantageous effects.

Moreover, with the liquid guidance case 140 including the bottom part 141 and the wall part 142, the liquid guidance case 140 easily receives the liquid L and easily holds the liquid L during the process of guiding the liquid L toward the inner wall surface 110W, thus allowing for more advantageous effects.

Moreover, with the liquid guidance case 140 positioned between the cover main body 121 and the image forming device 130 in the state where the top cover 120 is closed, a more stable image formation operation is achieved by the image forming device 130, thus allowing for more advantageous effects. In this case, with the liquid guidance case 140 positioned between the cover main body 121 and the fixing unit 30, the liquid L is prevented from reaching the fixing unit 30 that requires heat treatment, thus allowing for further advantageous effects.

Moreover, with the openable and closable top cover 120, a stable image formation operation is achieved by the image forming device 130 in the image forming apparatus with the opening and closing mechanism, thus allowing for more advantageous effects.

Moreover, with the top cover 120 rotatable about the pivot shaft J and the liquid guidance case 140 disposed on the opposite side to the side where the pivot shaft J is disposed, the liquid guidance case 140 does not get in the way of the pivot movement of the top cover 120. Therefore, the occurrence of problems with the image forming device 130 due to the liquid L is prevented while ensuring the pivot movement of the top cover 120, thus allowing for more advantageous effects.

Moreover, with the top cover 120 including the opening and closing lever 123, even if the liquid L gets into the housing 110 due to the presence of the opening and closing lever 123 (lever opening 120V), the liquid L is guided by the liquid guidance case 140 to the position away from the image forming device 130. Therefore, the occurrence of problems with the image forming device 130 due to the liquid L is prevented even if the opening and closing lever 123 is provided in the top cover 120, thus allowing for more advantageous effects. Such advantageous effects can also be achieved when the top cover 120 includes the operation panel 124 and thus the liquid L gets into the housing 110 due to the presence of the operation panel 124.

2. Image Forming Apparatus (Second Embodiment)

Next, description is given of an image forming apparatus according to a second embodiment. In the following description, reference is made to FIGS. 1 to 14 already described above.

In the image forming apparatus according to the first embodiment, the liquid guidance case 140 guides the liquid L along one guidance path G (G1) as described above. More specifically, the liquid guidance case 140 houses the liquid L in a state where the top cover 120 is closed, and then guides the liquid L toward the inner wall surface 110W along the guidance path G1.

On the other hand, in the image forming apparatus according to the second embodiment, a liquid guidance case 140 guides a liquid L along two guidance paths G (G1 and G2). More specifically, the liquid guidance case 140 houses the liquid L in a state where the top cover 120 is closed, and then guides the liquid L toward the inner wall surface 110W along the guidance path G1, as described in the first embodiment. The liquid guidance case 140 also guides the liquid L toward a channel 128 to be described later along the guidance path G2 different from the guidance path G1 described above, as the top cover 120 is opened with the liquid L housed in the liquid guidance case 140.

<2-1. Configuration>

The image forming apparatus according to the second embodiment has the same configuration as that of the image forming apparatus according to the first embodiment except for the liquid guidance case 140 and the top cover 120 having different configurations as described below. In the following description, reference is made, as needed, to FIGS. 1 to 14 already described above.

Figure 15:
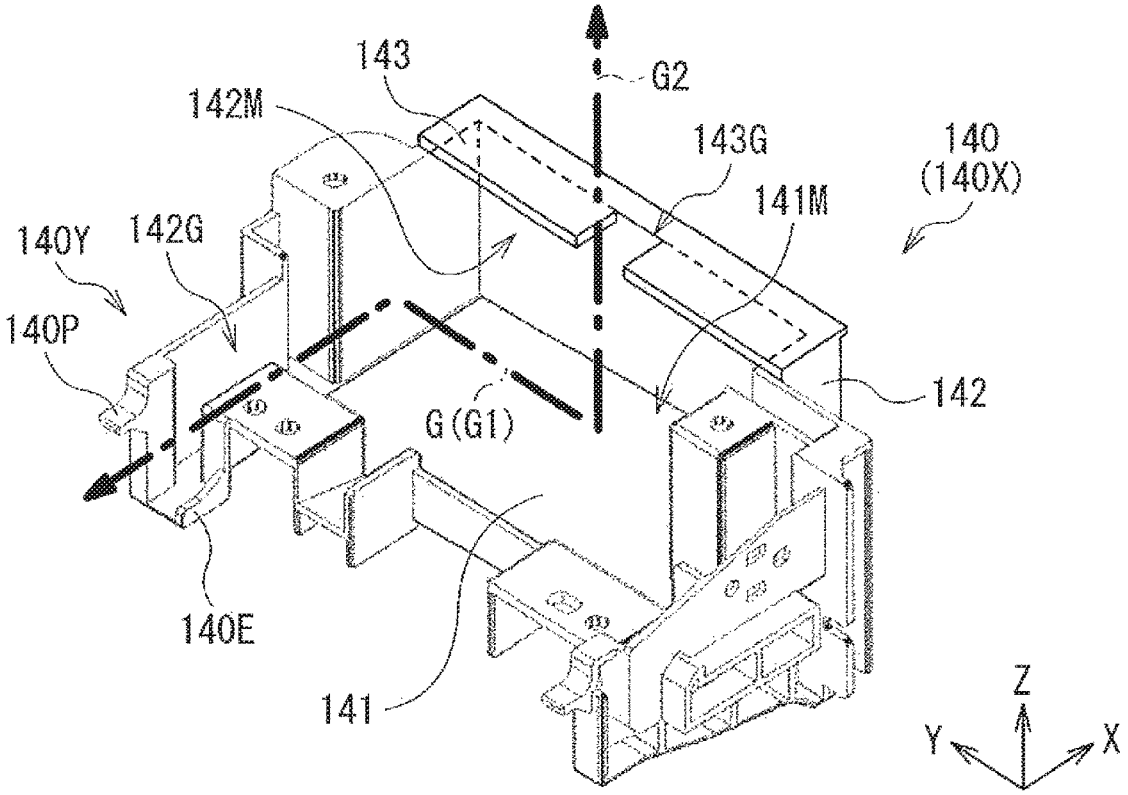
FIG. 15 is a diagram illustrating a perspective view of a configuration of a liquid guidance case in an image forming apparatus according to a second embodiment.
Figure 16:
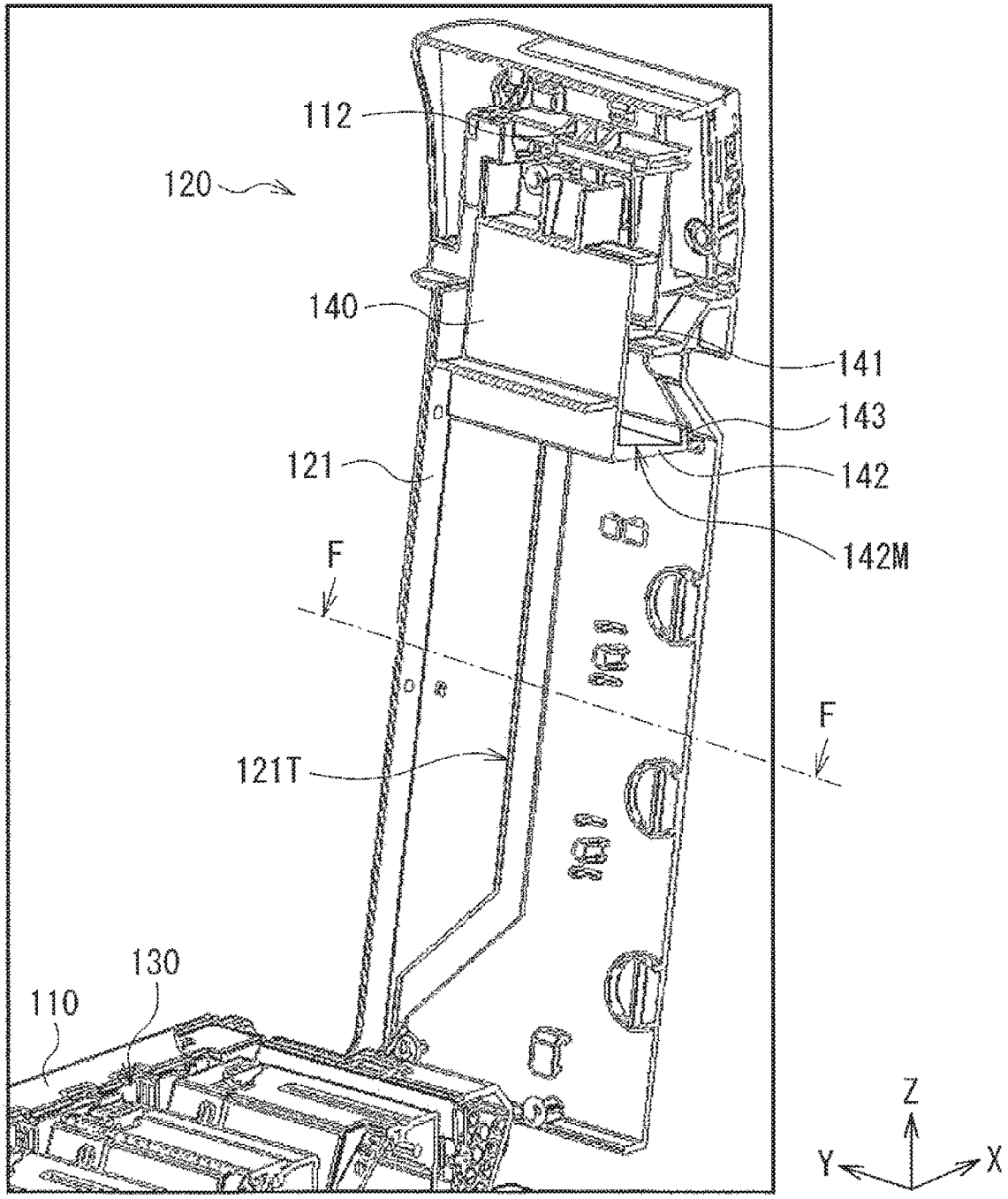
FIG. 16 is a diagram illustrating a partially enlarged perspective view of a configuration of the image forming apparatus (with a top cover opened)
Figure 17:
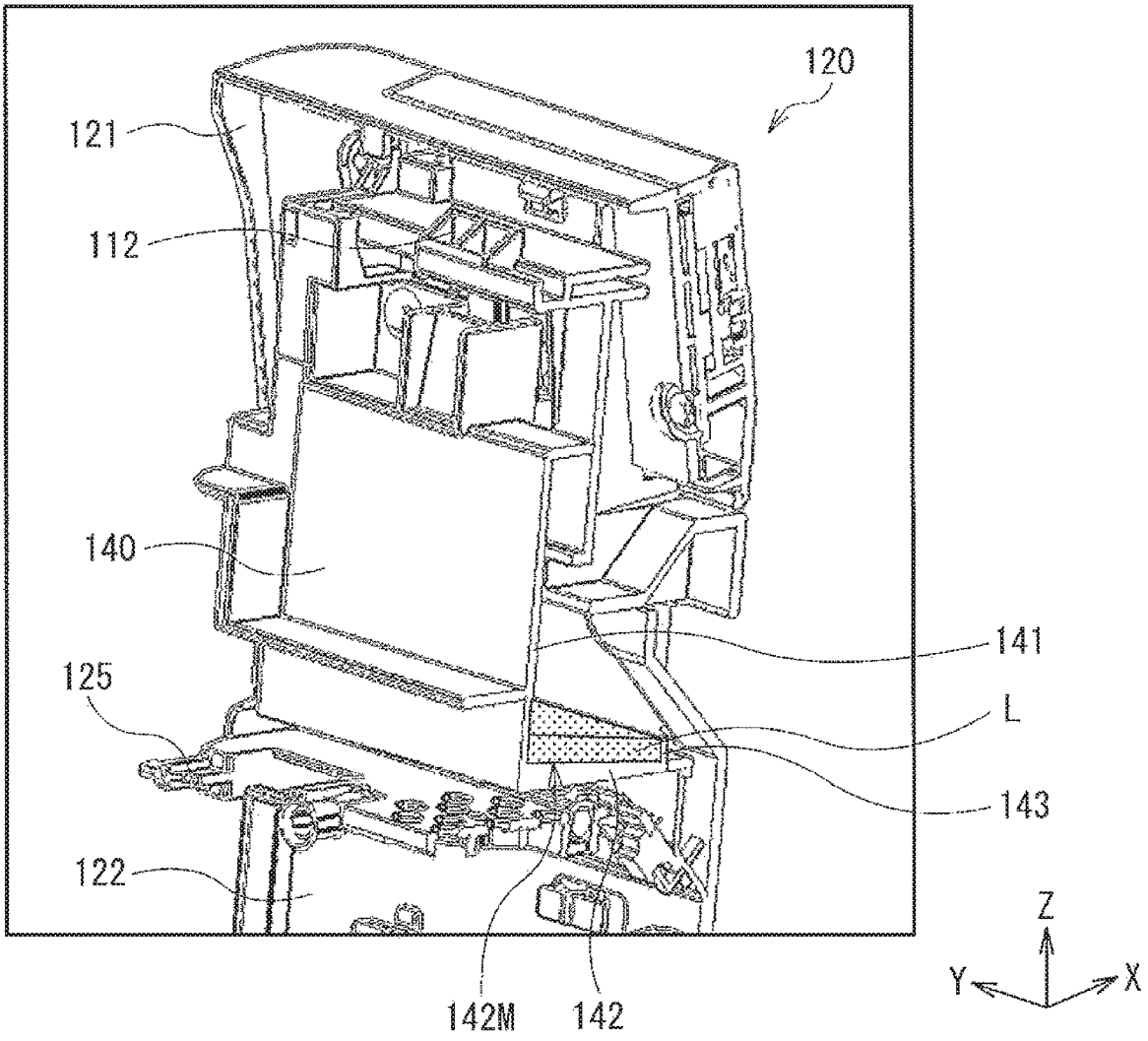
FIG. 17 is a diagram illustrating a partially enlarged perspective view of the configuration of the image forming apparatus illustrated in FIG. 16.
Figure 18:
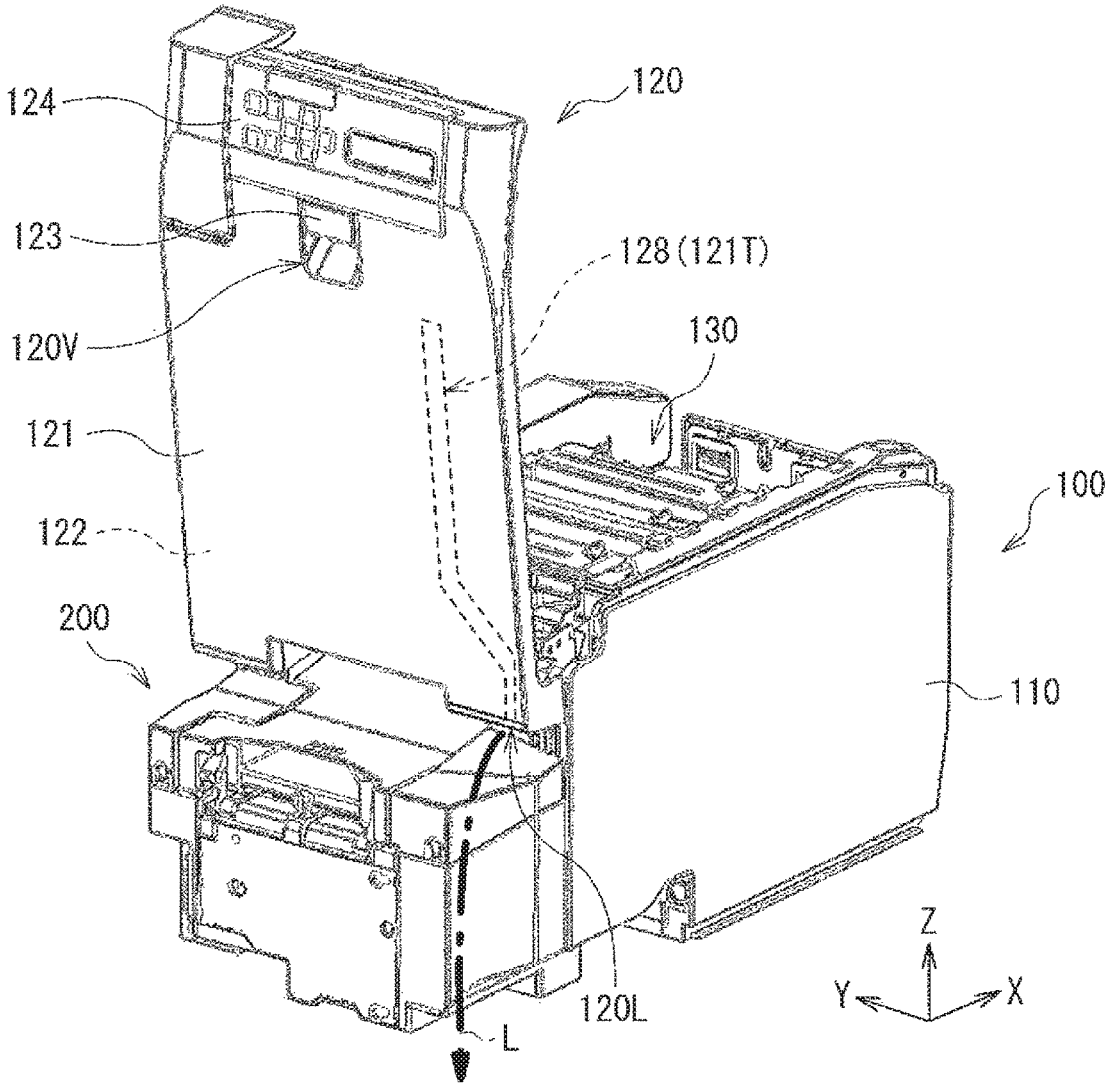
FIG. 18 is a diagram illustrating a perspective view of the configuration of the image forming apparatus (with the top cover opened)
Figure 19:
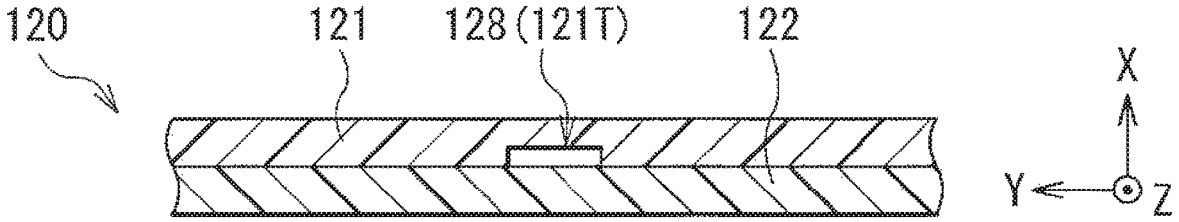
FIG. 19 is a diagram illustrating a cross-sectional view, taken along the line F-F of FIG. 16, of a configuration of the top cover.

FIG. 15 is a diagram illustrating a perspective view of a configuration of the liquid guidance case 140, which corresponds to FIG. 10. FIG. 16 is a diagram illustrating a partially enlarged perspective view of a configuration of the image forming apparatus, which corresponds to FIG. 2. FIG. 17 is a diagram illustrating a partially enlarged perspective view of the configuration of the image forming apparatus illustrated in FIG. 16. FIG. 18 is a diagram illustrating a perspective view of the configuration of the image forming apparatus. FIG. 19 is a diagram illustrating a cross-sectional view taken along the line F-F of FIG. 16, of a configuration of the top cover 120.

Note that FIGS. 16 to 18 each illustrate a state where the top cover 120 is opened. FIGS. 16 and 17 each illustrate a state where the image forming apparatus is sectioned along the line A-A of FIG. 1. FIG. 16 illustrates a state where the reinforcing plate 122 is removed from the top cover 120. FIG. 17 illustrates a state where a liquid L is housed in the liquid guidance case 140 with the liquid L indicated by hatching. FIG. 18 illustrates a state of the image forming apparatus when viewed from the rear side.

For example, in a state where the top cover 120 is opened, as described above, the liquid guidance case 140 further guides the liquid L in a direction (guidance path G2) different from the direction (guidance path G1) of guiding the liquid L in a state where the top cover 120 is closed.

To be more specific, the liquid guidance case 140 includes, for example, a bottom part 141, a wall part 142, and a roof part 143, as illustrated in FIGS. 15 to 17. This roof part 143 is away from the bottom part 141, for example, and connected to the wall part 142 so as to face a part of the lower side of the bottom part 141.

The roof part 143 included in the liquid guidance case 140 is used to hold the liquid L such that the liquid L does not spill even when the top cover 120 is opened in the state where the liquid L is housed in the liquid guidance case 140 as illustrated in FIG. 17.

The roof part 143 faces a part of the lower side of the bottom part 141 in the state where the top cover 120 is opened, so that the roof part 143 does not block the housing route of the liquid L to the liquid guidance case 140 in the state where the top cover 120 is closed and that the roof part 143 is used to keep the liquid L from spilling in the state where the top cover 120 is opened as illustrated in FIGS. 4, 15, and 17. Accordingly, the liquid guidance case 140 can house the liquid L in the state where the top cover 120 is closed, and can also hold the liquid L in the state where the top cover 120 is opened.

The roof part 143 includes, for example, a guidance opening 143G communicating with the channel 128 to be described later. More specifically, the liquid guidance case 140 can guide the liquid L to the channel 128 through the guidance opening 143G, for example, while housing the liquid L inside the container 140X in the state where the top cover 120 is opened.

In this case, the wall part 142 includes, for example, an inner wall surface 142M on the inside, that is, on the side where the liquid L is housed in the liquid guidance case 140, as illustrated in FIGS. 15 to 17. This inner wall surface 142M is tilted, for example, in the guidance path G2, to be more specific, tilted to gradually get lower toward the channel 128 in the state where the top cover 120 is opened. More specifically, the inner wall surface 142M is tilted, for example, to gradually get lower along the direction of guiding the liquid L in the X-axis direction in the state where the top cover 120 is opened. Thus, the liquid guidance case 140 can guide the liquid L to the channel 128, for example, by utilizing the tilt of the inner wall surface 142M described above.

The top cover 120 includes, for example, the channel 128 and a drainage port 120L as illustrated in FIG. 18.

The drainage port 120L is provided, for example, at a rear end of the cover main body 121 (for example, a distal end from the operation panel 124).

The channel 128 is a path through which the liquid L (FIG. 17) flows, and extends from a position corresponding to the liquid guidance case 140 (guidance opening 143G) to the drainage port 120L. To be more specific, a groove 121T is provided, for example, in the cover main body 121 on the side facing the reinforcing plate 122, as illustrated in FIG. 19, and the reinforcing plate 122 is adjoined to the cover main body 121 with the groove 121T provided therein. Thus, the groove 121T is used to form the channel 128.

The liquid guidance case 140 is disposed, for example, on the side closer to the operation panel 124 than the pivot shaft J, as described above. Therefore, the channel 128 communicates with the drainage port 120L, for example, by extending toward the side close to the pivot shaft J from the side close to the operation panel 124. Note that the extending pattern of the channel 128 is not particularly limited. Here, the channel 128 extends to the drainage port 120L, for example, while bending in a crank shape in the middle. Thus, the liquid guidance case 140 can guide the liquid L to the drainage port 120L, for example, through the channel 128.

The other configurations of the liquid guidance case 140 and the top cover 120 are as described in the first embodiment.

<2-2. Operations>

The image forming apparatus according to the second embodiment forms an image on the medium M in the same manner as the image forming apparatus according to the first embodiment. The image forming apparatus according to the second embodiment performs a drainage operation of the liquid L, for example, as described below.

In a state where the top cover 120 is closed, the liquid guidance case 140 houses the liquid L when the liquid L gets into the housing 110, and then guides the liquid L toward the inner wall surface 110W along the guidance path G1, as described above. Thus, the liquid L is guided to the guidance end 140E and then flows downward along the inner wall surface 110W to be drained from the liquid guidance case 140.

If the top cover 120 is opened before all the liquid L is guided toward the inner wall surface 110W after the liquid L is housed in the liquid guidance case 140, the roof part 143 is used to keep the liquid L from spilling in the liquid guidance case 140, as illustrated in FIGS. 15 to 19.

In this case, when the liquid L is housed in the container 140X, the tilt of the inner wall surface 142M is used to guide the liquid L to the channel 128 through a guidepath 140Y from the container 140X. Thus, the liquid L is guided along the guidance path G2 to the position away from the fixing unit 30, and thus drained from the liquid guidance case 140.

The liquid L guided to the channel 128 by the liquid guidance case 140 flows to the drainage port 120L through the channel 128, and thus is drained to the outside of the top cover 120 from the drainage port 120L as illustrated in FIG. 18.

<2-3. Advantageous Effects>

In the image forming apparatus according to this embodiment, the image forming device 130 is housed inside the housing 110, and the top cover 120 attached in a movable manner to the housing 110 includes the liquid guidance case 140. This liquid guidance case 140 supplies the liquid L to the channel 128 provided in the top cover 120 in a state where the top cover 120 is opened.

In this case, as illustrated in FIGS. 15 to 19, even if the liquid L is no longer guided toward the inner wall surface 110W in the guidance path G1 since the top cover 120 is opened in the state where the liquid L is housed in the liquid guidance case 140, the guidance path G2 provided separately from the guidance path G1 is used to guide the liquid L toward the channel 128. This prevents the liquid L from reaching the image forming device 130 even when the top cover 120 is opened by accident, thus further making the image forming device 130 free of problem caused by the contact with the liquid L. Therefore, a more stable image formation operation is achieved by the image forming device 130. Thus, the convenience of the image forming apparatus in use can be enhanced.

Particularly, with the liquid guidance case 140 including the bottom part 141 and the wall part 142 and the wall part 142 having the inner wall surface 142M tilted to gradually get lower toward the channel 128, the use of such a tilt of the inner wall surface 142M makes it easier to guide the liquid L to the channel 128, thus allowing for more advantageous effects.

3. Image Forming Apparatus (Third Embodiment)

Next, description is given of an image forming apparatus according to a third embodiment. In the following description, reference is made to FIGS. 1 to 19 already described above.

In the image forming apparatus according to the second embodiment, the liquid guidance case 140 is used to guide the liquid L, which gets into the housing 110 through the top cover 120, along the guidance paths G (G1 and G2) as described above.

On the other hand, in the image forming apparatus according to the third embodiment, a liquid guidance part 400 (or a liquid guidance structure 400) is used, instead of the liquid guidance case 140, to guide a liquid L, which gets into housings 110 and 210 from outside, along a guidance path G (G3). Here, the housings 110 and 210 may be referred to as "housings" according to an aspect of one or more embodiments of the disclosure.

<3-1. Overall Configuration>

The image forming apparatus according to the third embodiment has the same configuration as that of the image forming apparatus according to the second embodiment except for further including a battery 60 and the liquid guidance part 400 and for the housings 110 and 210 and the top cover 120 having different configurations as described below. In the following description, reference is made, as needed, to FIGS. 1 to 19 already described above. Here, the liquid guidance part 400 may be referred to as a "liquid guidance part" according to an aspect of one or more embodiments of the disclosure.

Figure 20:
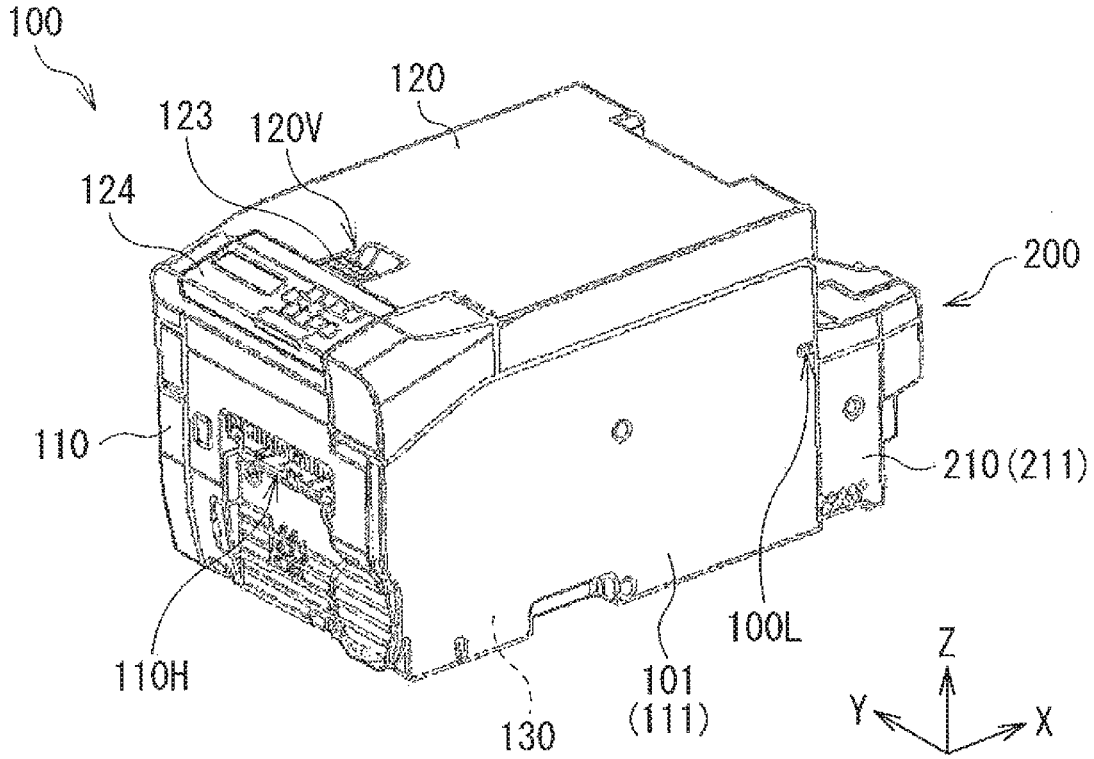
FIG. 20 is a diagram illustrating a perspective view of a configuration of an image forming apparatus (with a top cover closed) according to a third embodiment.
Figure 21:
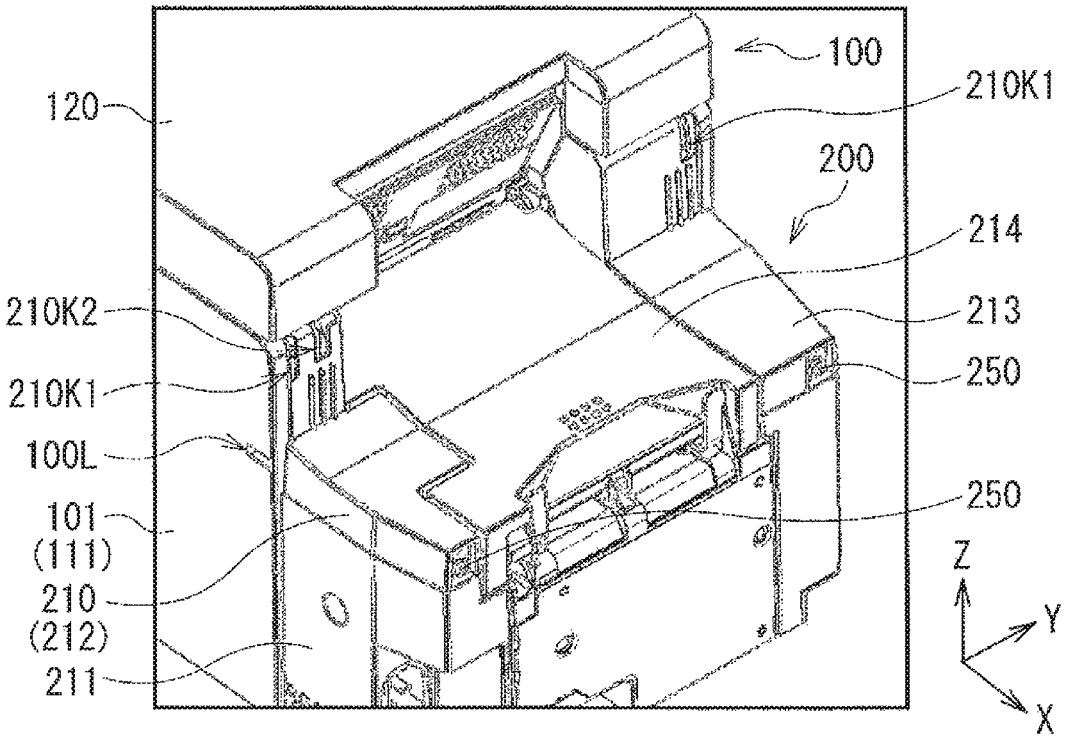
FIG. 21 is a diagram illustrating a partially enlarged perspective view of the configuration of the image forming apparatus illustrated in FIG. 20 (with a side rear cover and the like attached)
Figure 22:
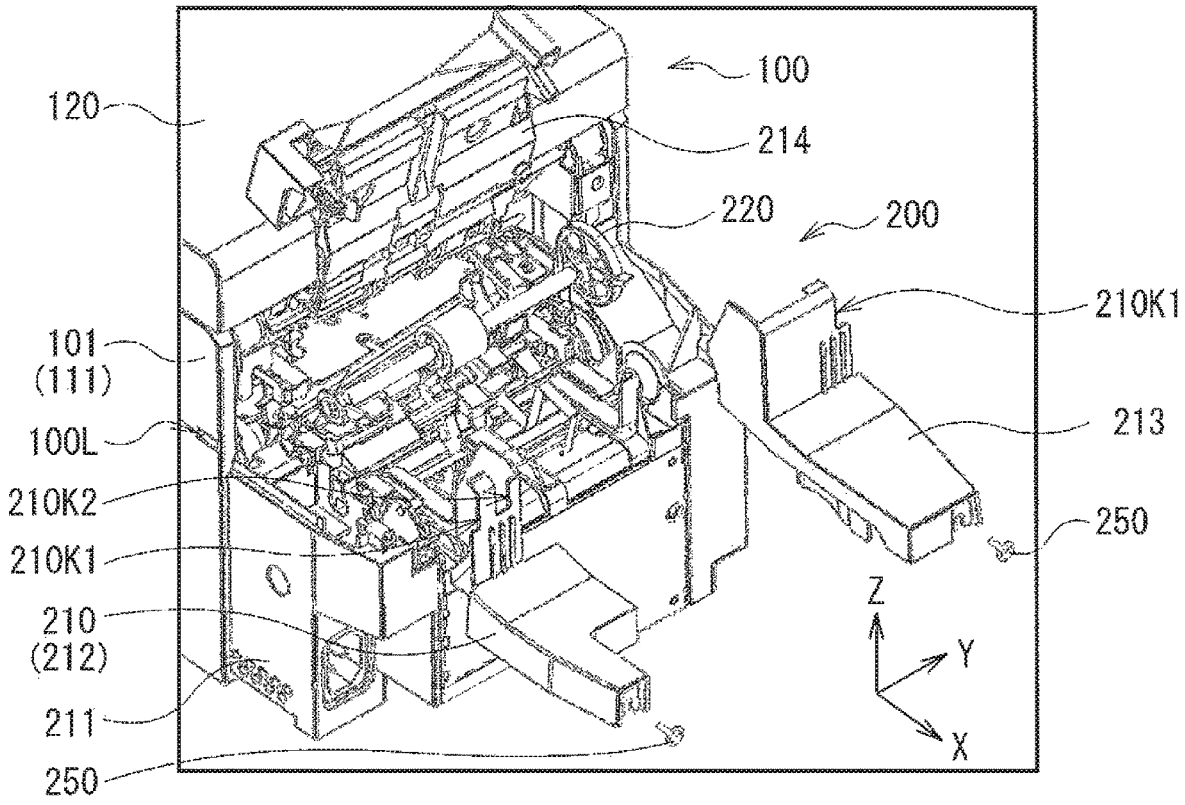
FIG. 22 is a diagram illustrating a partially enlarged perspective view of another configuration of the image forming apparatus illustrated in FIG. 20 (with the side rear cover and the like detached)
Figure 23:
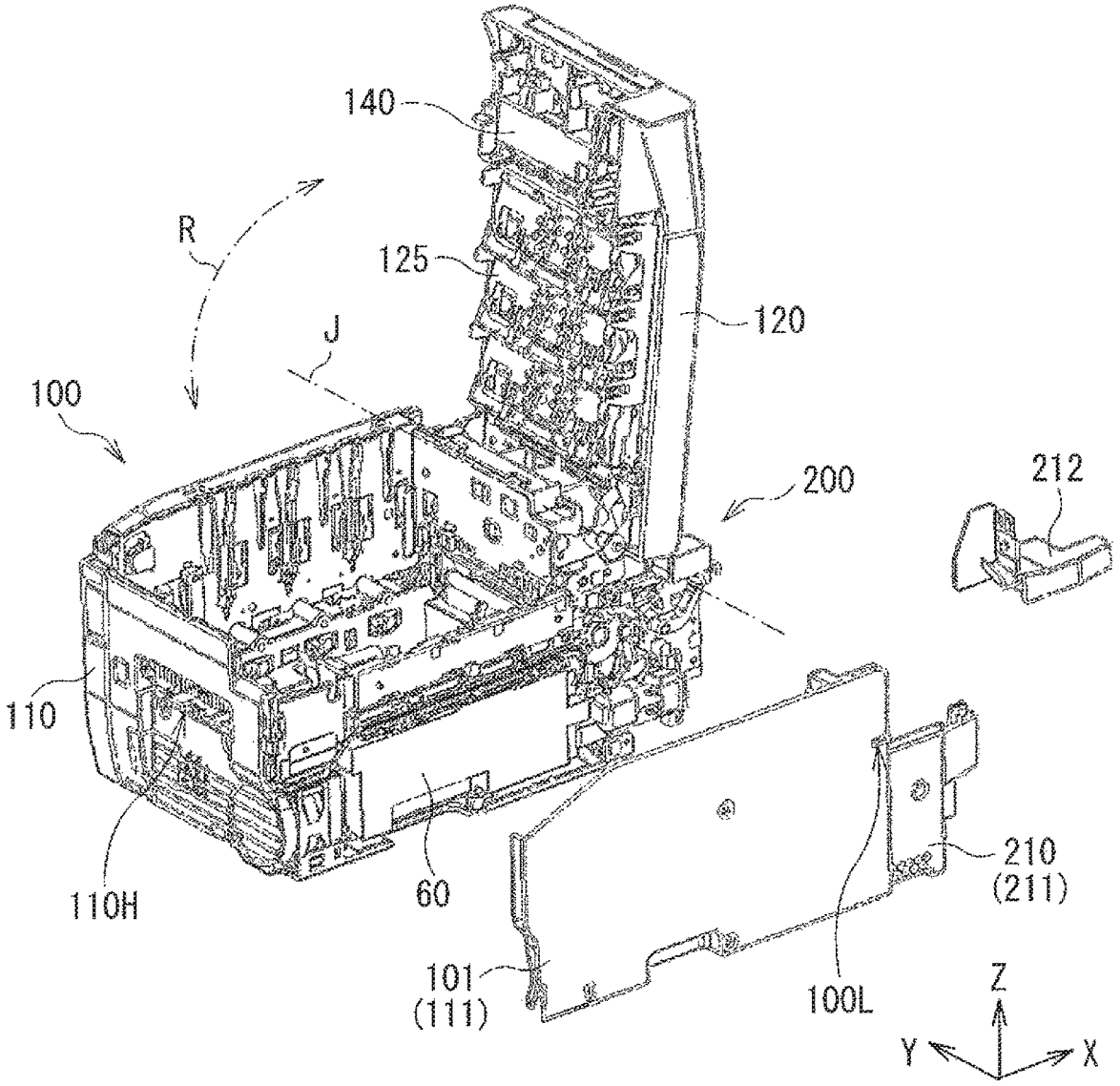
FIG. 23 is a diagram illustrating a perspective view of another configuration of the image forming apparatus illustrated in FIG. 20 (with the top cover opened)
Figure 24:
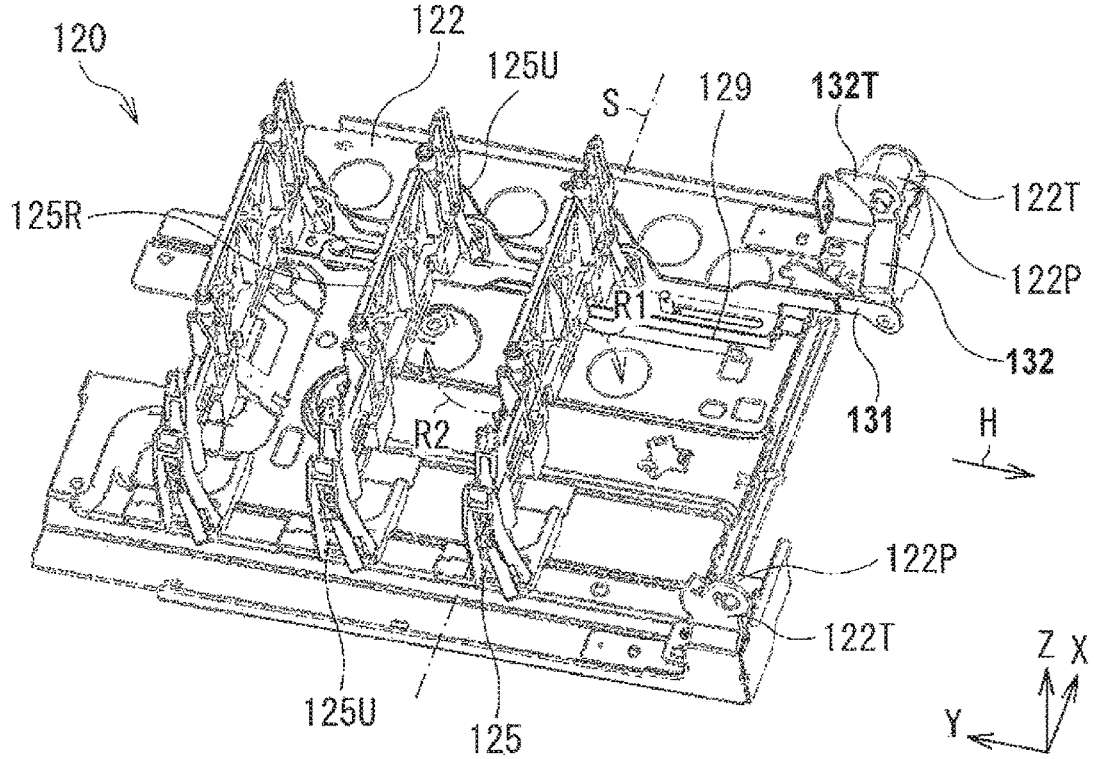
FIG. 24 is a diagram illustrating a perspective view of a configuration of the top cover illustrated in FIG. 23.
Figure 25:
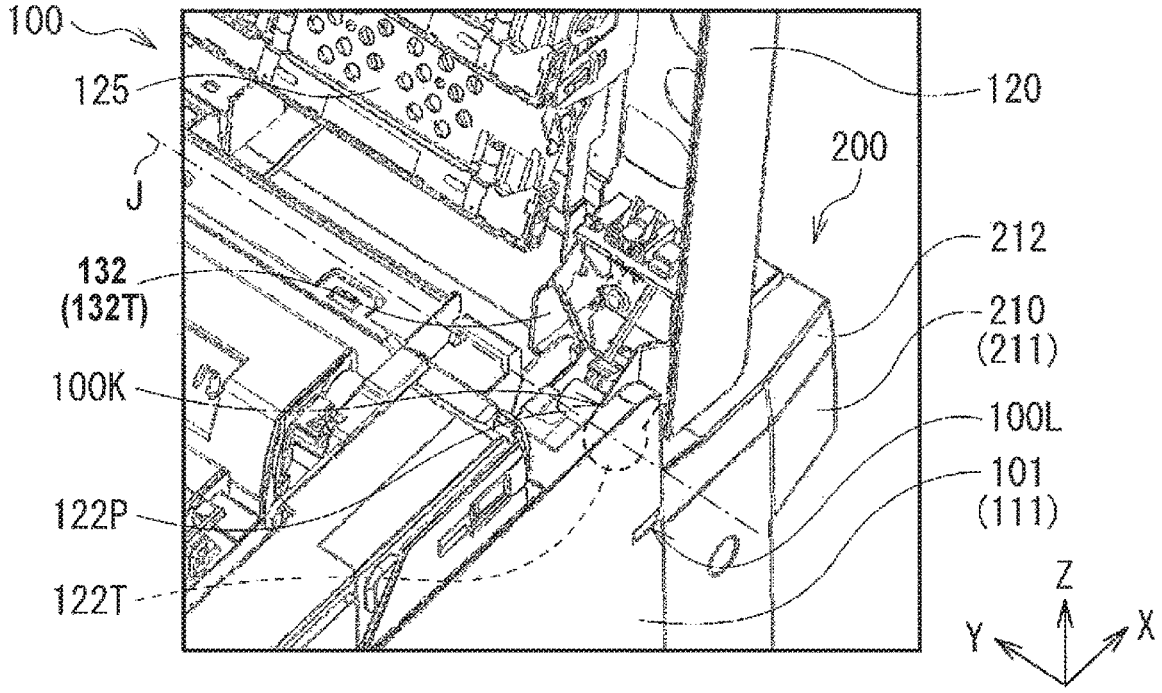
FIG. 25 is a diagram illustrating a partially enlarged perspective view of the configuration of the image forming apparatus illustrated in FIG. 23.

FIG. 20 is a diagram illustrating a perspective view of a configuration of the image forming apparatus, which corresponds to FIG. 1. FIGS. 21 and 22 are partially enlarged perspective views each illustrating the configuration of the image forming apparatus illustrated in FIG. 20. FIG. 23 is a diagram illustrating a perspective view of another configuration of the image forming apparatus, which corresponds to FIG. 2. FIG. 24 is a diagram illustrating a perspective view of a configuration of the top cover 120, which corresponds to FIG. 7. FIG. 25 is a diagram illustrating a partially enlarged perspective view of the configuration of the image forming apparatus illustrated in FIG. 23.

Note that FIG. 21 illustrates a state where a side rear cover 212 and the like are attached, while FIG. 22 illustrates a state where the side rear cover 212 and the like are detached. FIG. 23 illustrates a state where the image forming device 130 is detached and a side cover 101 (side covers 111 and 211) is detached. FIG. 24 illustrates a state where the cover main body 121 is detached.

[Battery]

The battery 60 is a power source for operating the image forming device 130 and the like, and is housed inside the housing 110 along with the image forming device 130. Here, the battery 60 is disposed, for example, on the side of the image forming device 130 (front side in FIG. 23) as illustrated in FIGS. 2 and 23. Here, the battery 60 is a "power source" according to an aspect of one or more embodiments of the disclosure.

[Housing]

The housing 110 houses the battery 60 together with the image forming device 130. This housing 110 includes, for example, the side cover 111 as illustrated in FIGS. 20 to 23. This side cover 111 is a detachable plate-like member, which is mainly a part (side plate) of the housing 110 to protect the battery 60. Note that the side cover 111 is detached as needed, for example, for the purpose of replacing the battery 60.

A drainage port 100L is provided, for example, in the side cover 111. This drainage port 100L is an opening for draining the liquid L (see FIG. 29) out of the image forming apparatus (housing 110) as described later.

The housing 210 includes, for example, the side cover 211, a pair of side rear covers 212 and 213, and a feeder cover 214, as illustrated in FIGS. 20 to 23. Here, the side rear cover 212 is a "second housing member" according to the embodiment of the present disclosure.

The side cover 211 is a detachable plate-like member, for example, which is a part (side plate) of the housing 210 disposed on the side (front side in FIG. 23) of a cutter 240, as illustrated in FIGS. 8 and 23.

The pair of side rear covers 212 and 213 are, for example, approximately lid-shaped detachable members disposed above the side cover 211, as illustrated in FIGS. 21 to 23, and fixed to the side cover 211 and the like with fixing screws 250. The side rear covers 212 and 213 are arranged, for example, so as to be away from each other and face each other with the feeder cover 214 interposed therebetween in the Y-axis direction. Note that the side rear covers 212 and 213 are detached as needed, for example, for the purpose of various maintenance operations (for example, replacing arbitrary parts) and the like.

The side rear covers 212 and 213 each include, for example, a pivot slit 210K1 near the top cover 120. This pivot slit 210K1 extends in the Z-axis direction, and is used to move the top cover 120, that is, to pivot (open and close) the top cover 120. Here, the pivot slit 210K1 is a "slit part" according to the embodiment of the present disclosure.

Note that the side rear cover 212 further includes a lever slit 210K2 near the top cover 120. This lever slit 210K2 extends in the Z-axis direction in the same manner as the pivot slit 210K1, and is used to turn a lever 132 to be described later.

The feeder cover 214 is a plate-like member disposed between the side rear covers 212 and 213, and is used, for example, for the purpose of replacing the roll-shaped medium M, and the like. This feeder cover 214 is rotatable, for example, about a rotation axis extending in the Y-axis direction, as illustrated in FIG. 22.

Here, the side covers 111 and 211 are integrated, for example, as illustrated in FIG. 23. Therefore, the image forming apparatus includes, for example, the side cover 101 formed by integrating the side covers 111 and 211. Here, the side cover 101 is a "first housing member" according to the embodiment of the present disclosure.

The side cover 101 includes the liquid guidance part 400 as described above. More specifically, the liquid guidance part 400 is a part of the side cover 101. This liquid guidance part 400 is attached to the inside of the housings 110 and 210 so as to be housed inside the housings 110 and 210 in a state where the top cover 120 is closed. The liquid guidance part 400 guides the liquid L to a position away from the battery 60 by guiding the liquid L getting into the housings 110 and 210 from the pivot slit 210K1 to the drainage port 100L along the guidance path G (G3). As a matter of course, the liquid guidance part 400 guides the liquid L so that the liquid L does not reach the image forming device 130 (particularly, the fixing unit 30) by guiding the liquid L to the position away from the battery 60. Note that the configuration of the liquid guidance part 400 is described later (see FIGS. 26 to 29).

[Top Cover]

The top cover 120 is attached to the housing 110 so as to be movable through the pair of pivot slits 210K1 provided in the respective side rear covers 212 and 213. The reinforcing plate 122 of the top cover 120 includes, for example, a pair of protrusion plates 122T, a pair of pivot shafts 122P, a slider 131, and a lever 132, as illustrated in FIG. 24. Thus, the top cover 120 performs pivot movement, for example, by using the pair of protrusion plates 122T and the pair of pivot shafts 122P, instead of the through-holes 126K.

The pair of protrusion plates 122T are, for example, plate-like members each protruding to face the housing 110 in the Z-axis direction, and are arranged away from each other while facing each other in the X-axis direction. The pair of pivot shafts 122P are, for example, protruding members which are away from each other in the X-axis direction and extend in a direction of approaching each other, and are supported by the pair of protrusion plates 122T. More specifically, one of the pivot shafts 122P is supported, for example, by one of the protrusion plates 122T, while the other pivot shaft 122P is supported, for example, by the other protrusion plate 122T. The pair of pivot shafts 122P are inserted into through-holes 110K provided in the housing 110, respectively.

Thus, the top cover 120 can be pivoted, for example, about the pair of pivot shafts 122P, and thus can be opened and closed. In this case, the top cover 120 can be pivoted, for example, by using the pivot slits 210K1 provided in the pair of side rear covers 212 and 213, respectively, together with the pair of pivot shafts 122P described above.

More specifically, to open the top cover 120, for example, the pair of protrusion plates 122T are pulled out of the pair of side rear covers 212 and 213 through the pair of pivot slits 210K1 in response to the pivot movement of the reinforcing plate 122. Therefore, even when the reinforcing plate 122 includes the pair of protrusion plates 122T to support the pair of pivot shafts 122P, the opening and closing operation of the top cover 120 (pivot movement of the reinforcing plate 122) is not hindered by the pair of protrusion plates 122T.

As a matter of course, to close the top cover 120, for example, the pair of protrusion plates 122T are housed inside the pair of side rear covers 212 and 213 through the pair of pivot slits 210K1 in response to the pivot movement of the reinforcing plate 122. Thus, the pair of protrusion plates 122T are housed inside the housings 110 and 210.

The slider 131 extends, for example, in the Y-axis direction and supports the head holders 125. Here, the slider 131 supports, for example, the three head holders 125 as described above. This slider 131 slides in the Y-axis direction while supporting the three head holders 125, for example, thereby making the head holders 125 movable by using the slide movement.

The lever 132 is a plate-like member with a protrusion 132T, and is connected to the slider 131. This lever 132 is supported, for example, by one of the pair of pivot shafts 122P and thus can be rotated about the one pivot shaft 122P. The slider 131 connected to the lever 132 is slidable, for example, in response to the rotation movement of the lever 132.

To be more specific, the head holder 125 includes, for example, a pair of supporting parts 125U and a rotating plate 125R that supports the light source 13 (see FIG. 9), as illustrated in FIG. 24. The pair of supporting parts 125U are arranged, for example, away from each other while facing each other in the X-axis direction. The rotating plate 125R is disposed between the pair of supporting parts 125U and supported by the pair of supporting parts 125U so as to be rotatable about a rotation axis S extending in the X-axis direction.

With the top cover 120 closed, for example, the slider 131 is energized in an energizing direction H by use of a spring 129 as illustrated in FIG. 24. Thus, in the head holder 125, the rotating plate 125R extends in a direction (Z-axis direction) intersecting with the extending direction (Y-axis direction) of the top cover 120.

When the top cover 120 is pivoted to open in this state, the lever 132 is rotated about the pivot shaft 122P by pushing of the protrusion 132T, and thus the slider 131 slides in a direction opposite to the energizing direction H. In this case, the rotating plate 125R is rotated about the rotation axis S as illustrated in FIG. 24. More specifically, a part of the rotating plate 125R is rotated in a rotation direction R1 about the rotation axis S, while the rest of the rotating plate 125R is rotated in a rotation direction R2 about the rotation axis S. Thus, in the state where the top cover 120 is opened, the rotating plate 125R extends in the same direction as the extending direction (Y-axis direction) of the top cover 120, unlike the state where the top cover 120 is closed as described above, as illustrated in FIGS. 23 and 25.

As a matter of course, when the top cover 120 is closed again, the slider 131 slides in the energizing direction H in response to the rotation movement of the lever 132, and thus the rotating plate 125R is rotated to extend in the direction intersecting with the extending direction of the top cover 120 as illustrated in FIG. 24.

In this case, the top cover 120 can be pivoted, for example, by using the lever slit 210K2 provided in the side rear cover 212.

More specifically, to open the top cover 120, for example, the lever 132 is pulled out of the side rear cover 212 through the lever slit 210K2 in response to the pivot movement of the reinforcing plate 122. Therefore, even when the lever 132 is attached to the reinforcing plate 122, the opening and closing operation of the top cover 120 (pivot movement of the reinforcing plate 122) is not hindered by the lever 132.

As a matter of course, to close the top cover 120, for example, the lever 132 is housed inside the side rear cover 212 through the lever slit 210K2 in response to the pivot movement of the reinforcing plate 122.

<3-2. Configuration of Liquid Guidance Part>

Figure 26:
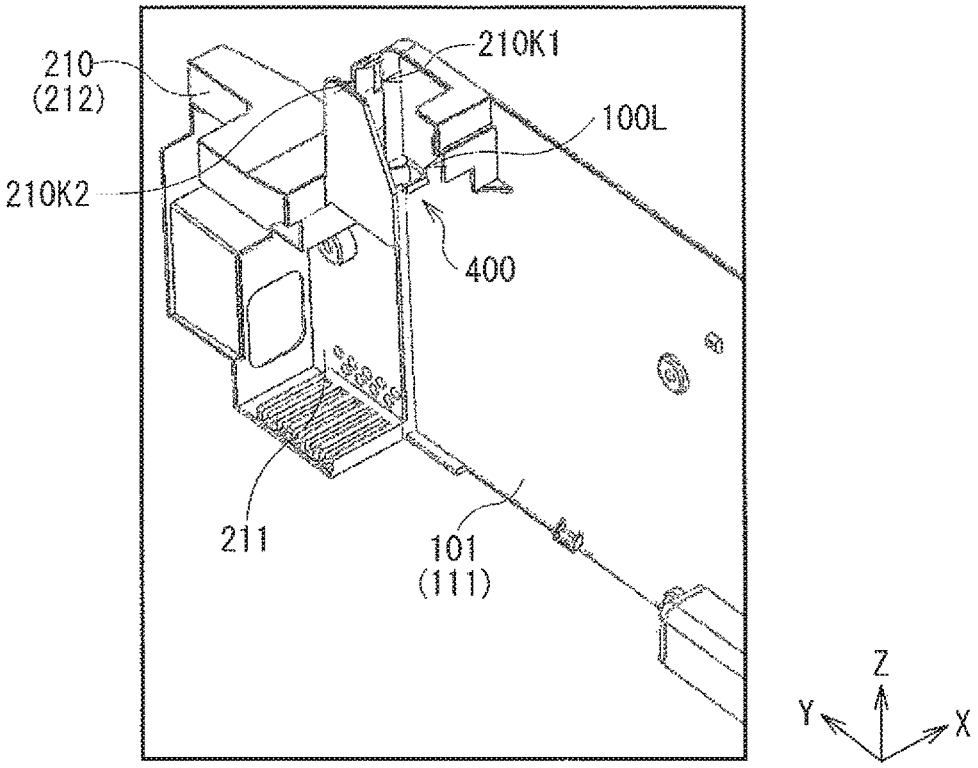
FIG. 26 is a diagram illustrating a perspective view of a configuration of a liquid guidance part.
Figure 27:
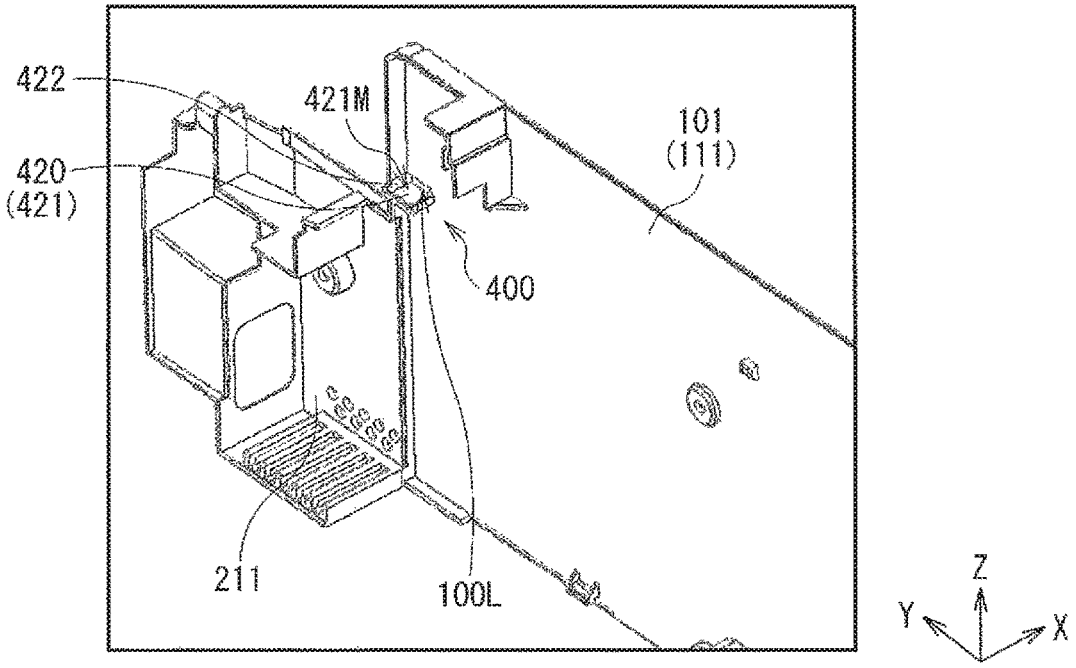
FIG. 27 is a diagram illustrating a perspective view of a part (receiving plate) of the configuration of the liquid guidance part illustrated in FIG. 26.
Figure 28:
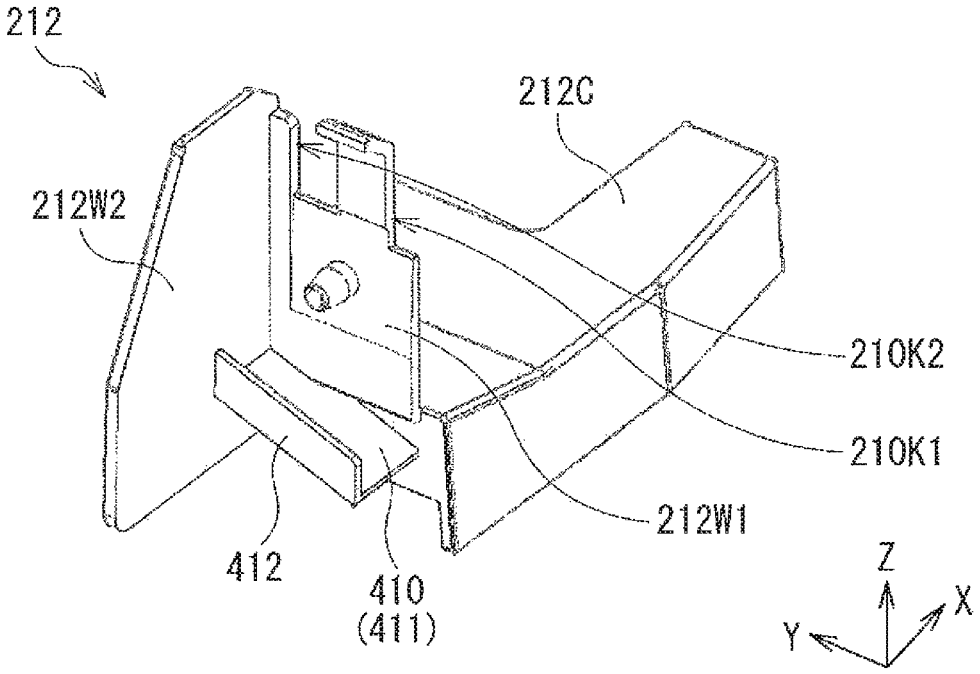
FIG. 28 is a diagram illustrating a perspective view of another part (guide plate) of the configuration of the liquid guidance part illustrated in FIG. 26.
Figure 29:
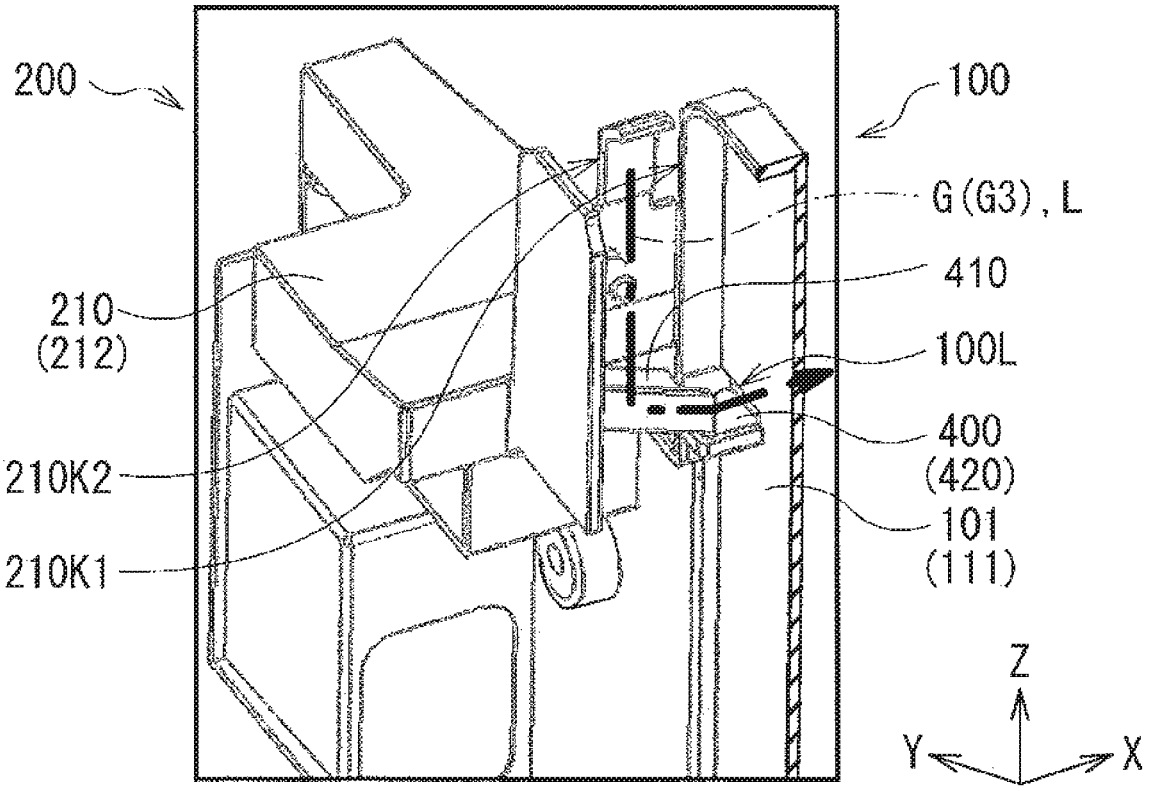
FIG. 29 is a diagram illustrating an enlarged perspective view of the configuration of the liquid guidance part illustrated in FIG. 26.

FIG. 26 is a diagram illustrating a perspective view of a configuration of the liquid guidance part 400. FIG. 27 is a diagram illustrating a perspective view of a part (receiving plate 420) of the configuration of the liquid guidance part 400 illustrated in FIG. 26. FIG. 28 is a diagram illustrating a perspective view of another part (guide plate 410) of the configuration of the liquid guidance part 400 illustrated in FIG. 26. FIG. 29 is a diagram illustrating an enlarged perspective view of the configuration of the liquid guidance part 400 illustrated in FIG. 26.

Note that FIGS. 26 and 29 also illustrate the side cover 101 (side covers 111 and 211) and the side rear cover 212. FIG. 29 illustrates a partially notched state of the side cover 101. FIG. 28 also illustrates the side rear cover 212 viewed from a different direction from that in FIG. 26.

The liquid guidance part 400 includes, for example, the guide plate 410 and the receiving plate 420 as illustrated in FIGS. 26 to 29. Here, the guide plate 410 is a "first liquid guidance member" according to the embodiment of the present disclosure. The receiving plate 420 is a "second liquid guidance member" according to the embodiment of the present disclosure.

[Guide Plate]

The guide plate 410 is a plate-like member that guides a liquid L toward a drainage port 100L, the liquid getting into the housings 110 and 210 from the pivot slit 210K1 provided in the side rear cover 212, and is attached to the inside of the side rear cover 212, for example.

The guide plate 410 extends, for example, from the pivot slit 210K1 toward the drainage port 100L, to be more specific, from below the pivot slit 210K1 toward the drainage port 100L. This is because such a configuration allows the guide plate 410 to easily receive the liquid L getting into the housings 110 and 210 from the pivot slit 210K1. Note, however, that the guide plate 410 is away from the side cover 101, for example.

In this case, the guide plate 410 preferably extends not only from below the pivot slit 210K1 but also from below both of the pivot slit 210K1 and the lever slit 210K2 toward the drainage port 100L. This is because such a configuration allows the guide plate 410 to easily receive also the liquid L getting into the housings 110 and 210 from the lever slit 210K2.

Moreover, the guide plate 410 is preferably tilted to gradually get lower toward the drainage port 100L. This is in order to allow the liquid L to be easily guided to the drainage port 100L by using the tilt of the guide plate 410.

To be more specific, the side rear cover 212 includes, for example, a cover main body 212C and two wall parts 212W1, 212W2, as illustrated in FIG. 28.

The cover main body 212C is, for example, an approximately box-shaped member that covers an opening (attachment space for the side rear cover 212) provided in the housing 210. The wall part 212W1 is, for example, a plate-like member along a YZ plane. The pivot slit 210K1 and the lever slit 210K2 are provided in the wall part 212W1, for example. The wall part 212W2 is, for example, a plate-like member along an XZ plane, and is connected to the wall part 212W1. The wall parts 212W1, 212W2 are arranged, for example, such that an angle formed by the wall parts 212W1, 212W2 is approximately right angle.

In this case, the guide plate 410 includes, for example, a guidance plate 411 and a side wall plate 412 as illustrated in FIG. 28.

The guidance plate 411 is, for example, a plate-like member extending in the Y-axis direction, that is, in a direction toward the drainage port 100L while being adjacent to the wall parts 212W1, 212W2, and guides the liquid L toward the drainage port 100L. This guidance plate 411 is tilted to gradually get lower toward the drainage port 100L.

The side wall plate 412 is, for example, a plate-like member provided upright along the guidance plate 411, and is disposed to face the wall part 212W1 across the guidance plate 411. This side wall plate 412 serves as a barrier that prevents the liquid L from falling off the guidance plate 411 when flowing toward the drainage port 100L over the guidance plate 411.

[Receiving Plate]

The receiving plate 420 is a plate-like member that feeds the liquid L into the drainage port 100L by receiving the liquid L guided toward the drainage port 100L by the guide plate 410, and is attached to the inside of the side cover 101 (110).

This receiving plate 420 is, for example, disposed at the drainage port 100L, to be more specific, below the drainage port 100L. This is in order to allow the liquid L received by the receiving plate 420 to be easily fed into the drainage port 100L.

The receiving plate 420 also partially overlaps with the guide plate 410. This is in order to allow the liquid L guided by the guide plate 410 to be easily received by the receiving plate 420. Note, however, that the receiving plate 420 may or may not come into contact with the guide plate 410, for example.

To be more specific, the receiving plate 420 includes, for example, a receiver plate 421 and a side wall plate 422 as illustrated in FIG. 27.

The receiver plate 421 is, for example, a plate-like member that receives the liquid L from the guide plate 410, and extends in a direction away from the drainage port 100L. This receiver plate 421 has, for example, a retention surface 421M that retains the liquid L, and the position of the retention surface 421M approximately matches the lower end position of the drainage port 100L, for example. This is because the liquid L received by the receiving plate 420 is easily drained from the drainage port 100L and is unlikely to remain on the receiving plate 420. Note, however, that the position of the retention surface 421M may be slightly shifted from the lower end position of the drainage port 100L, for example.

The side wall plate 422 is, for example, a plate-like member provided upright along the receiver plate 421, and is provided to surround the receiver plate 421 except for the spot adjacent to the side cover 101. This side wall plate 422 serves as a barrier that prevents the liquid L from falling off the receiving plate 420 when received by the receiving plate 420.

<3-3. Operations>

The image forming apparatus according to the third embodiment forms an image on the medium M in the same manner as the image forming apparatus according to the second embodiment. The image forming apparatus according to the third embodiment performs a drainage operation of the liquid L, for example, as described below.

When the liquid L gets into the housings 110 and 210 from the pivot slit 210K1 provided to allow for a moving operation of the top cover 120 (opening and closing operation by using pivot movement), the liquid guidance part 400 guides the liquid L to the drainage port 100L along the guidance path G3 as illustrated in FIG. 29.

To be more specific, when the liquid L gets into the housings 110 and 210 from the pivot slit 210K1, the liquid L is collected by the guide plate 410. Thus, the liquid L is received by the receiving plate 420 after flowing along the guide plate 410. Once the liquid L is received by the receiving plate 420, the liquid L is fed into the drainage port 100L.

Accordingly, the liquid guidance part 400 guides the liquid L to the drainage port 100L from the pivot slit 210K1. Thus, the liquid L is drained out of the housings 110 and 210 from the drainage port 100L.

In this case, the liquid guidance part 400 also guides the liquid L getting into the housings 110 and 210 from the lever slit 210K2 to the drainage port 100L, based on the same principle as that for the drainage of the liquid getting into the housings 110 and 210 from the pivot slit 210K1. Thus, the liquid L is also drained from the drainage port 100L.

<3-4. Advantageous Effects>

In the image forming apparatus according to this embodiment, the image forming device 130 and the battery 60 are housed inside the housings 110 and 210 (side cover 101 and side rear cover 212) including the pivot slit 210K1 and the drainage port 100L, and the top cover 120 is attached to the housings 110 and 210 so as to be movable through the pivot slit 210K1. These housings 110 and 210 include the liquid guidance part 400, and the liquid guidance part 400 guides the liquid L getting into the housings 110 and 210 from the pivot slit 210K1 to the drainage port 100L along the guidance path G (G3).

In this case, as illustrated in FIGS. 20 to 29, even when the liquid L gets into the housings 110 and 210 from the pivot slit 210K1 due to the pivot slit 210K1 provided in the side rear cover 212 to allow the top cover 120 to be opened and closed, the liquid L is guided to the drainage port 100L by the liquid guidance part 400 so as not to reach the battery 60. This makes it unlikely for the liquid L to reach the battery 60 even when the pivot slit 210K1 is used to allow the top cover 120 to be opened and closed, thus preventing occurrence of problems with the battery 60 due to the contact with the liquid L.

Therefore, a more stable image formation operation is achieved by the image forming device 130 using the battery 60. Thus, the convenience of the image forming apparatus in use can be enhanced.

In this case, the liquid L is unlikely to reach not only the battery 60 but also the image forming device 130. This further prevents the occurrence of problems with the image forming device 130 due to the contact with the liquid L. Thus, the convenience of the image forming apparatus in use can be further enhanced.

Particularly, the liquid guidance part 400 includes the guide plate 410 and the receiving plate 420, and the liquid L is easily guided to the drainage port 100L by the guide plate 410 and the receiving plate 420 guiding the liquid L to the drainage port 100L, thus allowing for more advantageous effects.

Note that, here, the description has been given of the case where the configuration of the image forming apparatus according to this embodiment is applied to the image forming apparatus according to the second embodiment. However, the configuration of the image forming apparatus according to this embodiment may be applied to the image forming apparatus according to the first embodiment.

4. Modified Example

The configuration of the image forming apparatus described above can be modified as needed.

Modified Example 1

Figure 30:
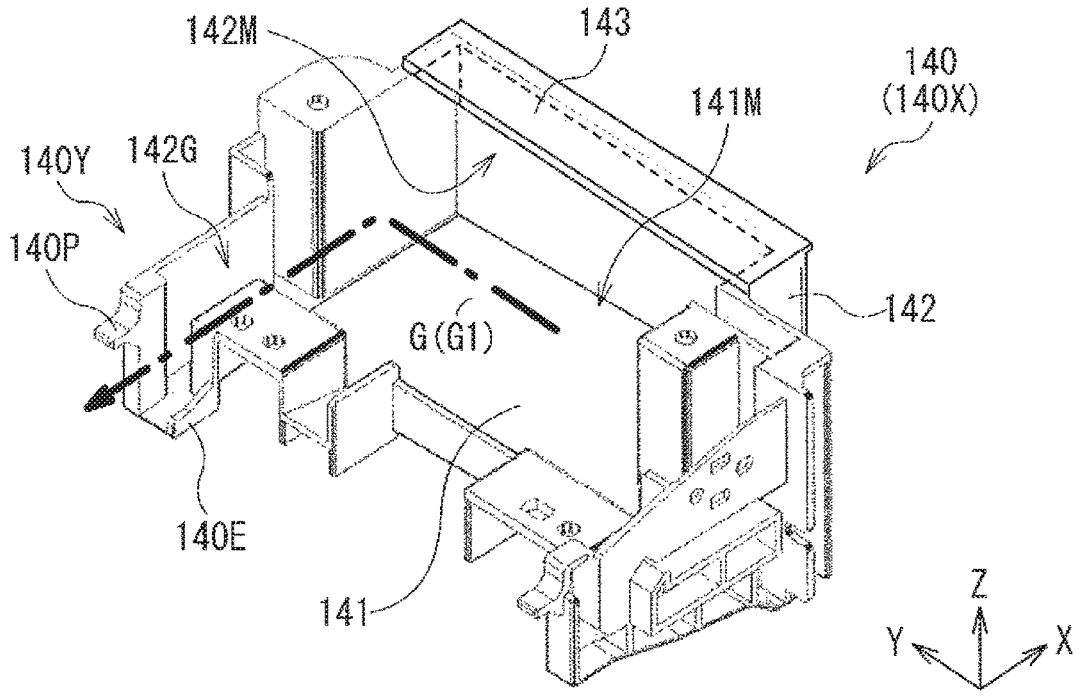
FIG. 30 is a diagram illustrating a perspective view for explaining Modified Example 1 of the configuration of the image forming apparatus.

To be more specific, in FIG. 15, the liquid guidance case 140 includes the guidance opening 143G. However, as illustrated in FIG. 30 corresponding to FIG. 15, for example, the liquid guidance case 140 does not have to include the guidance opening 143G. In this case, as a matter of course, the top cover 120 does not have to include the channel 128 and the drainage port 120L, since the liquid guidance case 140 does not include the guidance opening 143G.

In this case, again, when the liquid L gets into the housing 110 in a state where the top cover 120 is closed, the liquid L is guided by the liquid guidance case 140 to the position away from the image forming device 130. Thus, the same effects as those in the case of FIG. 15 can be achieved.

Note, however, that the liquid guidance case 140 may preferably include the guidance opening 143G, as illustrated in FIG. 15, in order to prevent the occurrence of problems with the image forming device 130 also in the state where the top cover 120 is opened after the liquid L is housed in the liquid guidance case 140. More specifically, the liquid guidance case 140 can preferably guide the liquid L to the drainage port 120L from the guidance opening 143G through the channel 128.

Modified Example 2

In FIG. 15, the liquid guidance case 140 includes the roof part 143. However, since the liquid guidance case 140 is in close contact with the cover main body 121 and the reinforcing plate 122, the liquid guidance case 140 does not have to include the roof part 143, as illustrated in FIG. 10, for example, when the liquid L is unlikely to spill from the liquid guidance case 140 without the roof part 143.

In this case, again, the same effects as those in the case of FIG. 15 can be achieved, since the liquid guidance case 140 guides the liquid L to the channel 128.

Modified Examples 3 and 4

Figure 31:
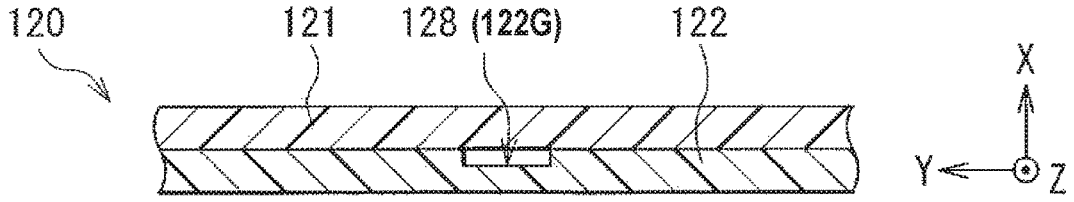
FIG. 31 is a diagram illustrating a cross-sectional view for explaining Modified Example 3 of the configuration of the image forming apparatus.
Figure 32:
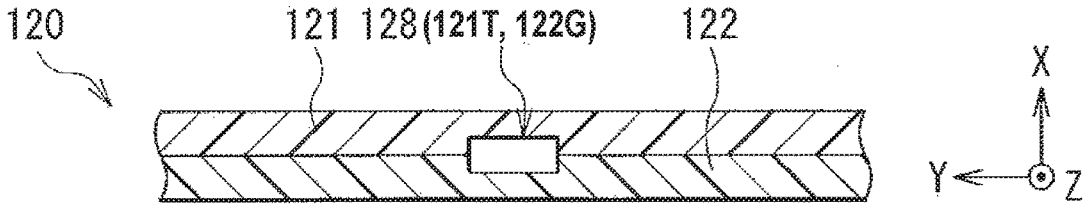
FIG. 32 is a diagram illustrating a cross-sectional view for explaining Modified Example 4 of the configuration of the image forming apparatus.

In FIG. 19, the channel 128 is formed by using the groove 121T provided in the cover main body 121 on the opposite side to the reinforcing plate 122. However, as illustrated in FIG. 31 corresponding to FIG. 19, for example, a groove 122G may be provided in the reinforcing plate 122 on the opposite side to the cover main body 121, and a channel 128 may be formed by using the groove 122G. Alternatively, as illustrated in FIG. 32 corresponding to FIG. 19, for example, a channel 128 may be formed by providing a groove 121T in the cover main body 121 and a groove 122G in the reinforcing plate 122.

In such cases, again, the same effects as those in the case of FIG. 19 can be achieved, since the liquid guidance case 140 guides the liquid L to the drainage port 120L through the channel 128.

Modified Example 5

Figure 33:
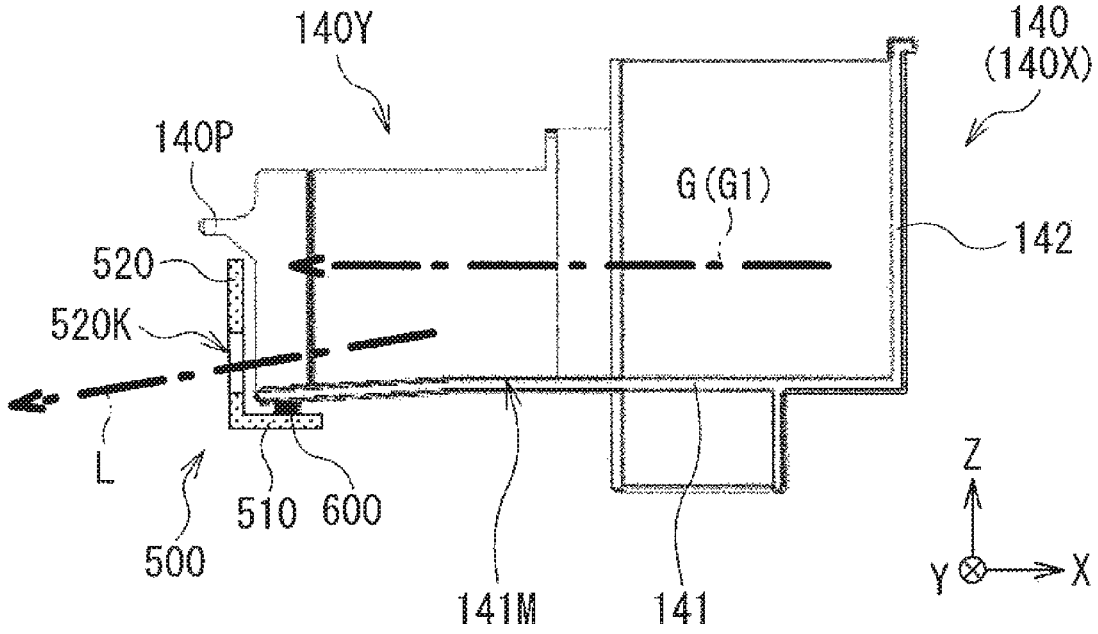
FIG. 33 is a diagram illustrating a plan view for explaining Modified Example 5 of the configuration of the image forming apparatus.
Figure 34:
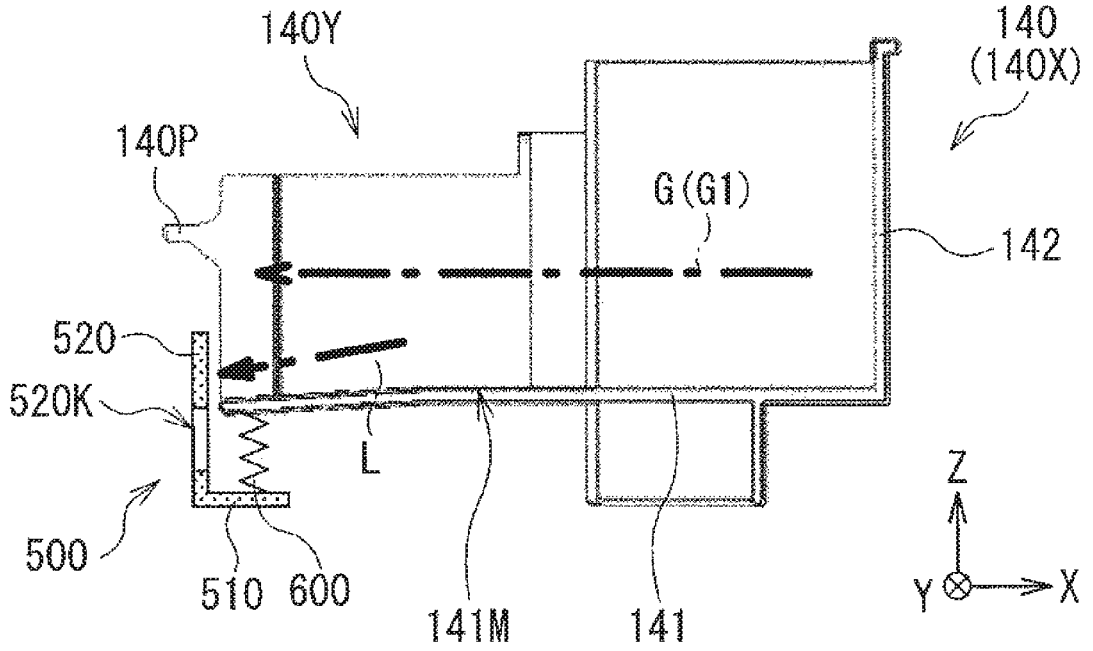
FIG. 34 is a diagram illustrating another plan view for explaining Modified Example 5 of the configuration of the image forming apparatus.

As illustrated in FIGS. 33 and 34 corresponding to FIG. 12, an opening and closing shutter 500 may be provided in the liquid guidance case 140 (guidepath 140Y). Note that FIG. 33 illustrates a state where the top cover 120 is closed, while FIG. 34 illustrates a state where the top cover 120 is opened. Here, the opening and closing shutter 500 is an "opening and closing member" according to the embodiment of the present disclosure.

The opening and closing shutter 500 switches whether or not to drain the liquid L during drainage of the liquid L from the liquid guidance case 140 toward the inner wall surface 110W. To be more specific, the opening and closing shutter 500 enables the drainage of the liquid L by opening the guidepath 140Y in the state where the top cover 120 is closed, and disables the drainage of the liquid L by blocking the guidepath 140Y in the state where the top cover 120 is opened.

As illustrated in FIGS. 33 and 34, for example, the opening and closing shutter 500 includes an energizing plate 510 and an opening and closing plate 520.

The energizing plate 510 is, for example, a plate-like member along the XY plane, and is disposed to face the lower surface of the liquid guidance case 140. An energizing part 600 such as a spring that is extendable in the Z-axis direction is disposed, for example, between the liquid guidance case 140 and the energizing plate 510. Thus, the energizing plate 510 is energized, for example, in a direction of separating from the liquid guidance case 140 (downward) by the energizing part 600. This energizing part 600 contracts, for example, in response to the opening and closing of the top cover 120, as described later.

The opening and closing plate 520 is, for example, a plate-like member along the YZ plane, and is disposed to face the guidepath 140Y and connected to the energizing plate 510. This opening and closing plate 520 includes, for example, an opening 520K for passing the liquid L. In FIGS. 33 and 34, the opening and closing shutter 500 is indicated by hatching except for the opening 520K.

Note that the opening and closing shutter 500 may further include, for example, a pair of side plates along the XZ plane.

In the image forming apparatus including the liquid guidance case 140 provided with the opening and closing shutter 500, whether or not to drain the liquid L is switched as described below.

In the state where the top cover 120 is closed, the opening and closing shutter 500 (energizing plate 510) comes into contact with the housing 110, and thus the housing 110 pushes the energizing plate 510 toward the liquid guidance case 140 through the energizing part 600. In this case, as illustrated in FIG. 33, the contraction of the energizing part 600 moves the opening and closing shutter 500 upward, and thus opening 520K overlaps with the guidepath 140Y. Accordingly, the liquid L is drained from the guidepath 140Y through the opening 520K.

In the state where the top cover 120 is opened, on the other hand, the opening and closing shutter 500 (energizing plate 510) is away from the housing 110, the housing 110 no longer pushes the energizing plate 510 toward the liquid guidance case 140 through the energizing part 600. In this case, as illustrated in FIG. 34, with the extension of the energizing part 600, the opening and closing shutter 500 is moved downward by the restoring force (energizing force) of the energizing part 600, and thus the opening 520K is shifted from the guidepath 140Y. Accordingly, the guidepath 140Y is blocked by the opening and closing shutter 500, and thus the liquid L is no longer drained from the guidepath 140Y through the opening 520K. Note that FIG. 33 illustrates a state where the opening and closing plate 520 is slightly away from the liquid guidance case 140 for a better view of the configuration of the opening and closing shutter 500. This opening and closing plate 520 may be disposed adjacent to the liquid guidance case 140, for example.

In this case, whether or not to drain the liquid L is switched in response to the opening and closing operation of the top cover 120. More specifically, the drainage of the liquid L is automatically enabled in the state where the top cover 120 is closed, while the drainage of the liquid L is automatically disabled in the state where the top cover 120 is opened. Therefore, in the state where the top cover 120 is closed, problems with the image forming device 130 due to the contact with the liquid L are unlikely to occur as described above. Moreover, since the liquid L is unlikely to spill from the guidepath 140Y in the state where the top cover 120 is opened, problems with the image forming device 130 due to the contact with the liquid L unintentionally spilling from the guidepath 140Y are also unlikely to occur, thus allowing for more advantageous effects.

Modified Example 6

Figure 35:
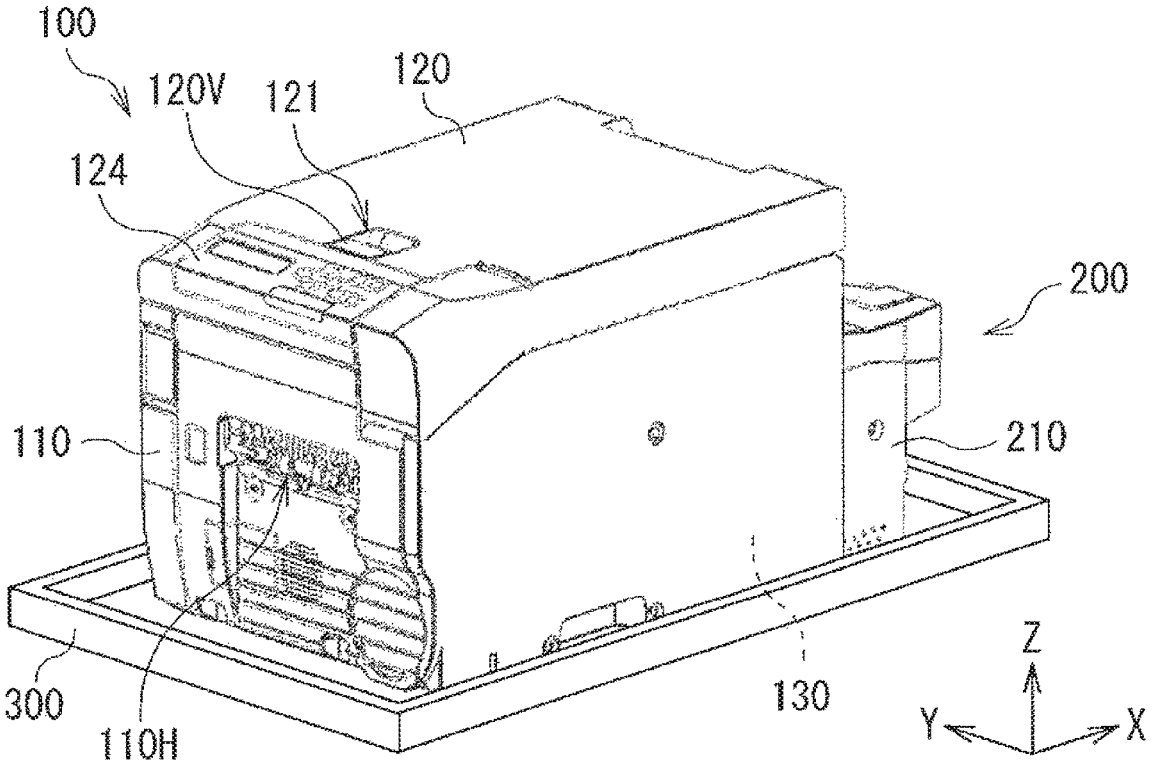
FIG. 35 is a diagram illustrating a perspective view for explaining Modified Example 6 of the configuration of the image forming apparatus.

As illustrated in FIG. 35 corresponding to FIGS. 1 and 20, for example, the image forming apparatus may be disposed inside a tray 300. Note that FIG. 35 illustrates, for example, a state where the image forming apparatus illustrated in FIG. 1 is disposed inside the tray 300. This tray 300 is a box-shaped member with an opening on its upper side. In this case, the liquid L discharged from the image forming apparatus (drainage port 100L and the like) is collected by the tray 300, thus preventing the liquid L from flowing around the image forming device. Accordingly, surrounding objects are prevented from unintentionally getting wet with the liquid L discharged from the image forming apparatus, thus allowing for more advantageous effects. Note that the kinds of the surrounding objects are not particularly limited but include, for example, a table on which the image forming apparatus is placed, objects other than the image forming apparatus placed on the table, and the like.

Modified Example 7

In FIGS. 20 to 29, the liquid guidance part 400 is provided in a spot corresponding to the pivot slit 210K1 provided in the side rear cover 212. However, another liquid guidance part 400 may be further provided in a spot corresponding to the pivot slit 210K1 provided in the side rear cover 213. This further prevents the liquid L from reaching the battery 60, thus allowing for more advantageous effects.

Modified Example 8

Other than the above, the number of a series of constituent components included in the image forming apparatus to discharge the liquid L can be arbitrarily changed. To be more specific, the number of the guidance openings 142G is not limited to 1 but may be 2 or more, for example. In this case, again, the same effects can be achieved. Particularly when the number of the guidance openings 142G is 2 or more, the liquid guidance case 140 is allowed to easily guide the liquid L to a position away from the image forming device 130, thus allowing for more advantageous effects. Note that the same goes for the numbers of the guidance openings 143G, the drainage ports 100L, the channels 128, and the like.

Although the present invention has been described above with reference to some embodiments, the aspects of the present invention are not limited to those described in the respective embodiments, but may be modified in various ways. To be more specific, the image forming apparatus according to one embodiment of the present invention does not have to include any paper feed unit, for example. In this case, the image forming apparatus may include media previously cut into a predetermined dimension. Moreover, the image forming apparatus according to one embodiment of the present invention is not limited to a printer, for example, but may be a copy machine, a fax machine, a multifunction machine, or the like.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. An image forming apparatus comprising:
an image forming part that forms an image;
a housing that houses the image forming part and includes an inner wall surface; and
a top cover rotatably attached to the housing so as to be movable between a position where the top cover closes an upper opening of the housing and a position where the top cover opens the upper opening of the housing, wherein
the top cover includes a cover main body part and a liquid receiver that is supported by the cover main body part and configured to receive a liquid getting into the housing,
in a state where the top cover closes the upper opening of the housing, the liquid receiver is disposed between the cover main body part and the image forming part and located at an upper position above the image forming part,
in a state where the top cover opens the upper opening of the housing, the liquid receiver is disposed outside the upper position above the image forming part, and
the liquid receiver is adjacent to the inner wall surface in the state where the top cover closes the upper opening of the housing.

2. The image forming apparatus according to claim 1, wherein the liquid receiver is away from the inner wall surface in the state where the top cover opens the upper opening of the housing.

3. The image forming apparatus according to claim 1, wherein the liquid receiver includes a bottom surface that receives the liquid, and the bottom surface is tilted to gradually get lower toward the inner wall surface.

4. The image forming apparatus according to claim 1, wherein the liquid receiver includes a guidance path that guides the liquid toward the inner wall surface, and the guidance path is adjacent to the inner wall surface in the state where the top cover closes the upper opening of the housing.

5. The image forming apparatus according to claim 4, wherein the top cover further includes an opening and closing member that opens the guidance path in the state where the top cover closes the upper opening of the housing and blocks the guidance path in the state where the top cover opens the upper opening of the housing.

6. The image forming apparatus according to claim 1, wherein the liquid receiver includes a bottom part that receives the liquid and a wall part connected to the bottom part while surrounding the bottom part.

7. The image forming apparatus according to claim 1, wherein the image forming part includes a developing unit that forms an image on a medium with a toner, and a fixing unit that fixes the toner onto the medium, and the liquid receiver is positioned between the cover main body part and the fixing unit in the state where the top cover closes the upper opening of the housing.

8. The image forming apparatus according to claim 1, wherein the top cover includes a pivot shaft about which the top cover rotates, and the liquid receiver is disposed on the opposite side of the top cover to the side where the pivot shaft is disposed.

9. The image forming apparatus according to claim 1, wherein the top cover further includes a lever that is engageable with the housing, in such a manner that the top cover closes the upper opening of the housing with the lever being engaged with the housing whereas the top cover can be opened with the lever being disengaged from the housing, the housing further includes a lever opening in which the lever is disposed in the state where the top cover closes the upper opening of the housing with the lever being engaged with the housing, and the liquid receiver receives the liquid getting into the housing through the lever opening of the housing, in the state where the top cover closes the upper opening of the housing.

10. The image forming apparatus according to claim 1, wherein the top cover further includes an operation unit that receives an instruction to the image forming part, and the liquid receiver receives the liquid getting into the housing through the operation unit, in the state where the top cover closes the upper opening of the housing.

11. The image forming apparatus according to claim 1, wherein the top cover further includes a channel through which the liquid flows, and the liquid receiver supplies the liquid to the channel in the state where the top cover opens the upper opening of the housing.

12. The image forming apparatus according to claim 11, wherein the liquid receiver includes a bottom part that receives the liquid in the state where the top cover closes the upper opening of the housing and a wall part that is connected to the bottom part while surrounding the bottom part, and includes an inner wall surface tilted to gradually get lower toward the channel in the state where the top cover opens the upper opening of the housing.

13. The image forming apparatus according to claim 1, wherein the liquid receiver is opposed to and adjacent to the inner wall surface with a gap in a range of 1 mm to 5 mm therebetween in the state where the top cover closes the upper opening of the housing, such that the liquid received on the liquid receiver is discharged from the gap and flows down along the inner wall surface of the housing.

14. The image forming apparatus according to claim 1, wherein the liquid receiver is opposed to and adjacent to the inner wall surface with a gap in a range of 2 mm to 3 mm therebetween in the state where top cover closes the upper opening of the housing, such that the liquid received on the liquid receiver is discharged from the gap and flows down along the inner wall surface of the housing.

15. The image forming apparatus according to claim 1, wherein in the state where the top cover opens the upper opening of the housing, the liquid receiver is disposed outside the upper position above the image forming part and does not overlap with the image forming part in a plan view.

16. An image forming apparatus comprising:

an image forming part that forms an image on a medium;

a housing including an inner surface that defines a housing space in which the image forming part is housed, and including an upper opening; and a top cover rotatably attached to the housing such that the top cover opens and closes the upper opening of the housing, wherein the top cover includes a cover main body part and a liquid receiver that is supported by the cover main body part and configured to receive a liquid getting into the housing, the liquid receiver includes a guidance path that guides the liquid, an exit of the guidance path is adjacent to the inner surface in a state where the top cover closes the upper opening of the housing, in the state where the top cover closes the upper opening of the housing, the liquid receiver is disposed between the cover main body part and the image forming part and located at an upper position above the image forming part, and in a state where the top cover opens the upper opening of the housing, the liquid receiver is disposed outside the upper position above the image forming part.

* * * * *